US006578586B2

(12) United States Patent
Moh

(10) Patent No.: US 6,578,586 B2
(45) Date of Patent: Jun. 17, 2003

(54) SINGLE CHAMBER DISHWASHING MACHINE

(76) Inventor: Chee Boon Moh, 188, Taman Kota Jaya, Kota Sarang Semut, Kedah 06800 (MY)

( * ) Notice: Subject to any disclaimer, the term of this patent is extended or adjusted under 35 U.S.C. 154(b) by 55 days.

(21) Appl. No.: 09/799,331

(22) Filed: Mar. 5, 2001

(65) Prior Publication Data

US 2001/0042557 A1 Nov. 22, 2001

(51) Int. Cl.[7] ..... B08B 3/00

(52) U.S. Cl. ..... 134/25.2; 134/10; 134/29; 134/30; 134/33; 134/34; 134/95.3; 134/104.2; 134/153; 134/158

(58) Field of Search ..... 134/10, 25.2, 29, 134/30, 33, 34, 95.3, 104.2, 111, 153, 158

(56) References Cited

U.S. PATENT DOCUMENTS 3,776,465 A * 12/1973 Baker ..... 239/251
4,088,145 A * 5/1978 Noren ..... 134/104.4
4,150,679 A * 4/1979 Cushing et al. ..... 134/104.1
4,346,723 A * 8/1982 Geiger ..... 134/104.4
4,972,861 A * 11/1990 Milocco et al. ..... 134/104.1
5,097,855 A * 3/1992 Martinsson et al. ..... 134/104.4
5,131,420 A * 7/1992 Favret et al. ..... 134/104.1
5,267,580 A * 12/1993 Payzant ..... 134/108

* cited by examiner

*Primary Examiner*—Zeinab El-Arini
(74) *Attorney, Agent, or Firm*—Merchant & Gould P.C.

(57) ABSTRACT

An improved dishwashing machine is proposed which has a dish-cleaning compartment, a dish-rack rotating mechanism, a re-circulating fluid spraying system, a non re-circulating fluid spraying system, a drainage mechanism, a waste filter tank and a controlling means. The dish-cleaning compartment includes a cover and a casing, which includes a re-circulating fluid spray arm and a non re-circulating fluid spray arm. Automatic chemical dispenser, hot air dish-drying system and ultraviolet light sterilizer are included as optional features. Dish-cleaning operation starts with a flush cycle and then follows by a wash cycle and a rinse cycle. A dish-drying operation is introduced at the end of the rinse cycle, to dry as well as to sanitize dishes.

18 Claims, 24 Drawing Sheets

SINGLE CHAMBER DISHWASHING MACHINE

TECHNICAL FIELD OF THE INVENTION

The present invention relates to a single chamber dishwashing machine.

BACKGROUND OF THE INVENTION

Conventionally, a single chamber dishwashing machine has a dish-cleaning compartment for washing and rinsing purposes. Soiled dishes are loaded onto a dish-rack, which is then transferred to the dish-cleaning compartment.

Initially, fresh water and detergent filling valves are activated to allow pre-determined amount of fresh water and detergent to flow into a water sump which is located within the dish-cleaning compartment. The mixture of fresh water and detergent (which is known as wash water or wash fluid) will then be heated up to a pre-defined temperature by a water heating system located at the water sump. Structurally, the water sump is built as part of the dish-cleaning compartment.

During a wash cycle, the loaded dish-rack is stationed at the dish-cleaning compartment and is sprayed with random pattern of wash water through two rotating spray arms which is located above and below the loaded dish-rack. The heated and chemically treated wash water is re-circulating through the rotating spray arms for a pre-determined period to remove all food residue and other contamination from the soiled dishes.

At the end of the wash cycle, a drain valve is activated to drain off all the "used" wash water from the water sump. After the wash cycle, the dishwashing machine will proceed to a rinse cycle.

During the rinse cycle, fresh water and rinse agent filling valves is activated to allow a pre-determined amount of fresh water and rinse agent to inject into the water sump located within the dish-cleaning compartment. The mixture of fresh water and rinse agent (which is known as rinse water) will then be heated up to a pre-defined temperature by the water heating system located at the water sump.

The heated and chemically treated rinse water is sprayed randomly from the rotating spray arms onto the dishes to remove the left over of the wash water and to sanitize the dishes. Generally, the rinse water in conventional dishwashing machine is being cross-contaminated by the wash water. The reason being both wash water and rinse water are sharing the same rotating spray arms and are circulating through the same piping and pumping system.

Another major disadvantage of the conventional dishwashing machine is the wash water being heavily contaminated by the soiled dishes during the wash cycle due to a no effective pre-wash flush cycle being included. Besides, for every wash cycle, a completely fresh wash water make-up is needed. The intensive wash water make-up indirectly increases the overall consumption of fresh detergent per dish.

Yet another disadvantage of the conventional dishwashing machine is the ineffectiveness of the rotating spray arm cleaning method, which creates an inefficient random spraying pattern. Studies shown that a substantial area of the soiled dishes is not reachable by the random spraying pattern.

Another disadvantage of the conventional dishwashing machine is high temperature (about 180° F.) of wash water and rinse water being used to heat up and to sanitize the dishes.

Lately, a number of dishwashing machine manufacturer tries to modify their dishwashing machine design by introducing a lower temperature and chemical sterilize washing method where more rinsing and sterilizing chemical is added into the rinse water. However, this method is still not very cost effective due to the extra chemical cost incurred.

Therefore, a few unique features are introduced in the present invention to address the disadvantages of the conventional dishwashing machine.

SUMMARY OF THE INVENTION

It is a primary object of the present invention to provide an improved and cost effective single chamber dishwashing machine.

Another object of the present invention is to provide a dishwashing machine having a dish-rack rotating mechanism to improve cleaning efficiency.

Yet another object of the present invention is to provide a dishwashing machine having multiple angles spraying pattern, where the dishwashing fluid is channeled from multiple locations, which includes top, bottom and side(s) of a loaded dish-rack.

A further object of the present invention is to provide a dishwashing machine having isolated re-circulating fluid spraying system and non re-circulating fluid spraying system to minimize cross contamination of the rinse fluid.

Another object of the present invention is to provide a pre-wash flush cycle to minimize cross contamination of the wash fluid.

According to the most general aspect of the invention, the object is accomplished by a single chamber dishwashing machine comprising:

- a dish-cleaning compartment having a cover and a casing;
- a re-circulating fluid spraying system wherein a re-circulating fluid is delivered to a re-circulating fluid spray arm;
- a non re-circulating fluid spraying system wherein a non re-circulating fluid is delivered to a non re-circulating fluid spray arm;
- a dish-rack rotating mechanism and drive for rotating a dish-rack holder a dish-rack;
- a drainage mechanism for chanelling a used flush fluid a used wash fluid or a used rinse fluid from the dish-cleaning compartment to a designated drain location; and
- a controlling means for controlling the dishwashing machine operation.

Preferably, the single chamber dishwashing machine further comprises:

- a re-circulating fluid tank for holding the re-circulating fluid including a fresh wash fluid, the used wash fluid and the used rinse fluid;
- a non re-circulating fluid tank for holding the non re-circulating fluid including a fresh flush fluid and a fresh rinse fluid;
- a waste filter tank for filtering the used flush fluid, the used wash fluid and the used rinse fluid;
- a re-circulating fluid pumping system for pumping the re-circulating fluid from the re-circulating fluid tank to the re-circulating fluid spray arm; and
- a non re-circulating fluid pumping system for pumping the non re-circulating fluid from the non re-circulating fluid tank to the non re-circulating fluid spray arm.

Preferably, the dishwashing machine further comprises of an automated chemical dispenser for facilitating a cleaning detergent and other cleaning/rinsing chemical dispensing.

Also, preferably, the re-circulating fluid spray arm and the non re-circulating fluid spray arm are pivotable for swinging a water jet.

The above and other objects, features, aspects and advantages of the present invention will become clearer from the following detailed description of the present invention when taken in connection with the accompanying drawings.

The drawings are for purpose of illustration only and not intended as a definition of the limits of the invention. It being understood that various changes in the details may be made without departing from the spirit and advantages of the present invention.

BRIEF DESCRIPTION OF THE DRAWINGS

Embodiments of the invention are represented in the drawings and described in greater detail in the following description, in which drawings.

DETAILED DESCRIPTION OF THE DRAWINGS

Figure 1:
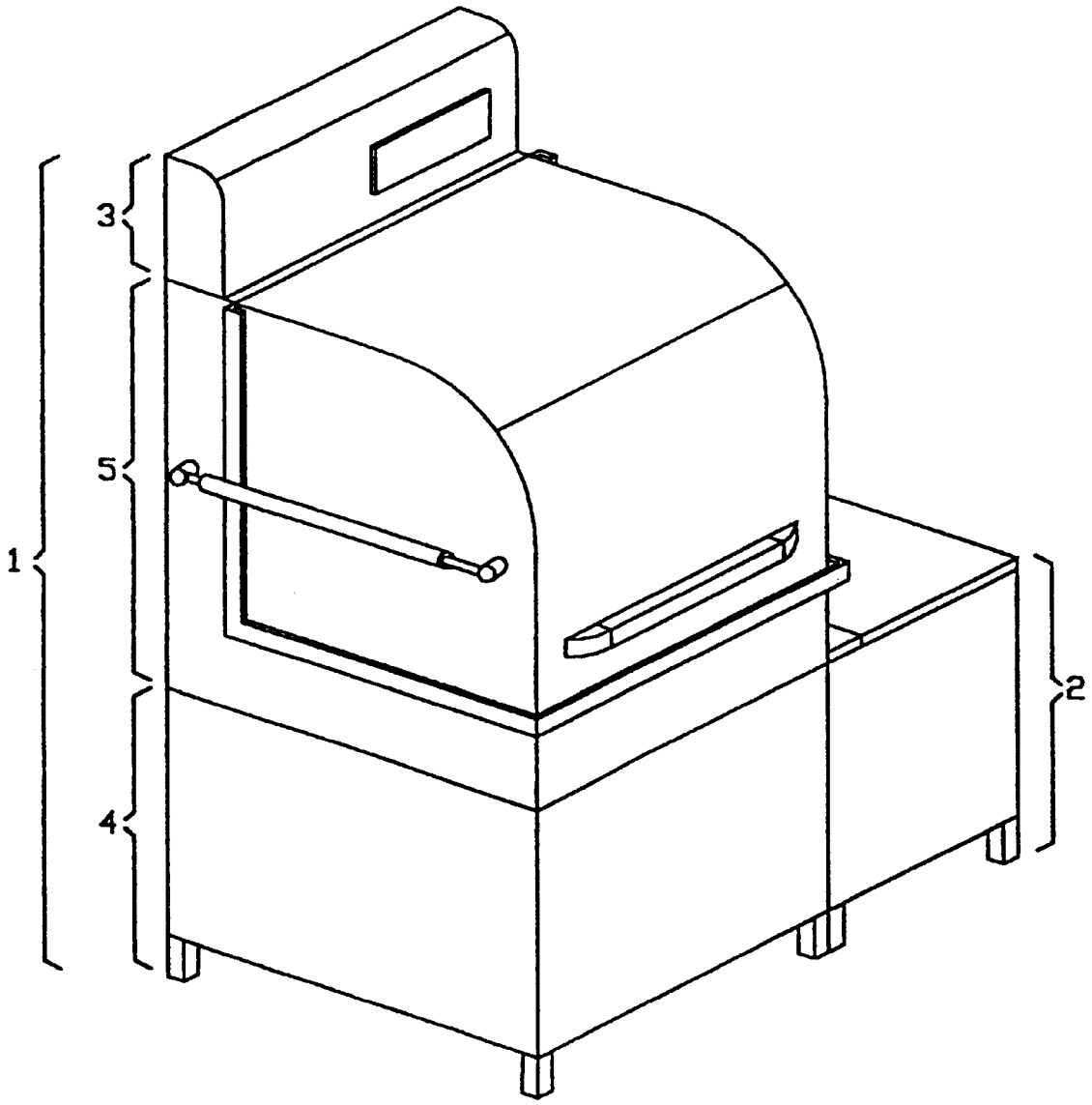
FIG. 1 shows a perspective view of a dishwashing machine according to the invention, where an entry cover is in the closed position.
Figure 2:
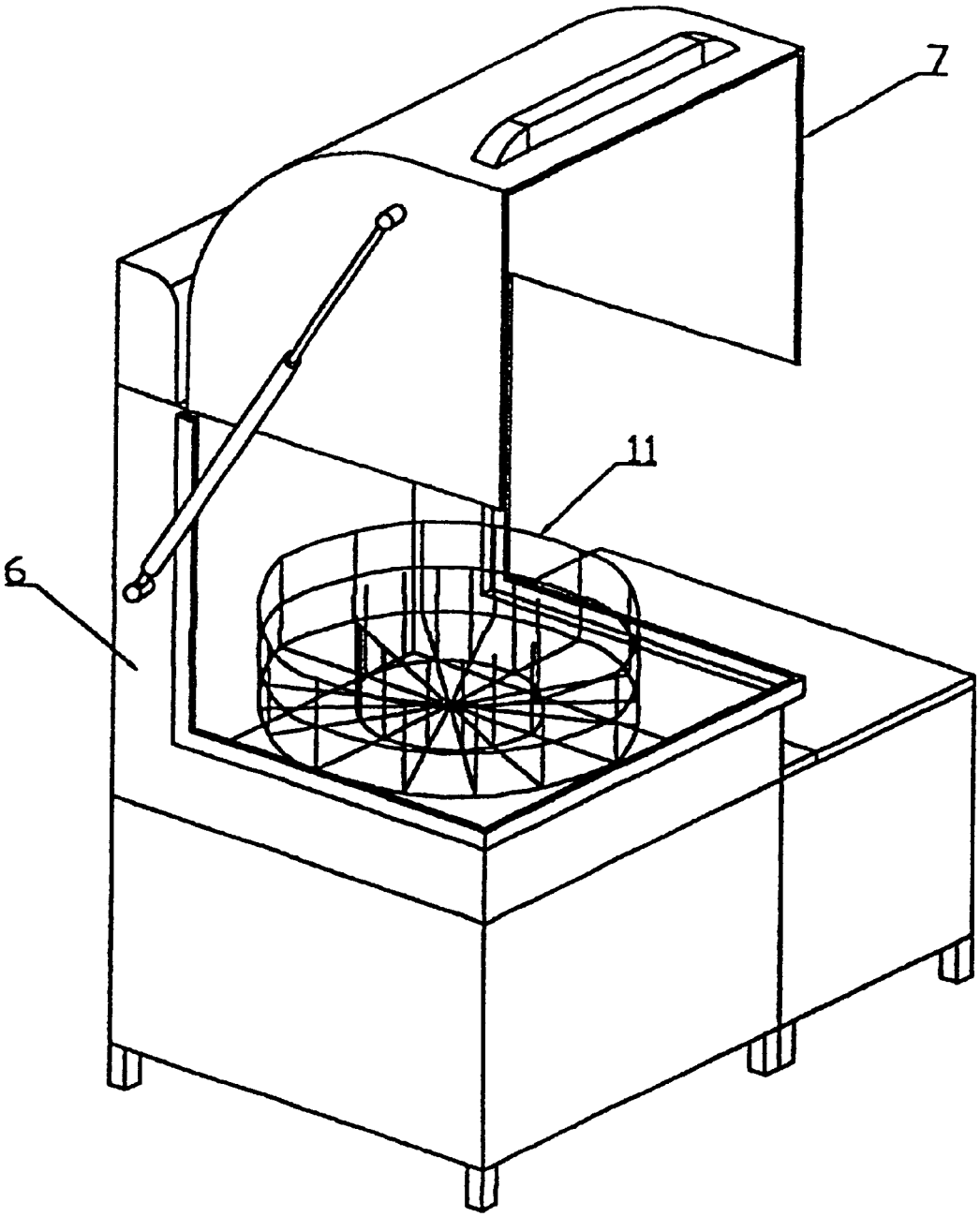
FIG. 2 shows a perspective view of the dishwashing machine according to the invention, where the entry cover is in the opened position.

A perspective view of the dishwashing machine according to the invention is shown in FIG. 1 and FIG. 2. Referring to FIG. 1, the dishwashing machine generally comprises a main cabinet [1] and a sub-cabinet [2].

Basically, the main cabinet has a top compartment [3] at the upper portion, a supporting frame compartment [4] at the lower portion and a dish-cleaning compartment [5] at the middle portion, which has a cover [7] and a casing [6]. The casing [6] has a slope shaped casing base [8] as shown in FIGS. 3 to 8. The top compartment [3] has an electrical control system and other electrical components such as hot air blower.

Figure 21:
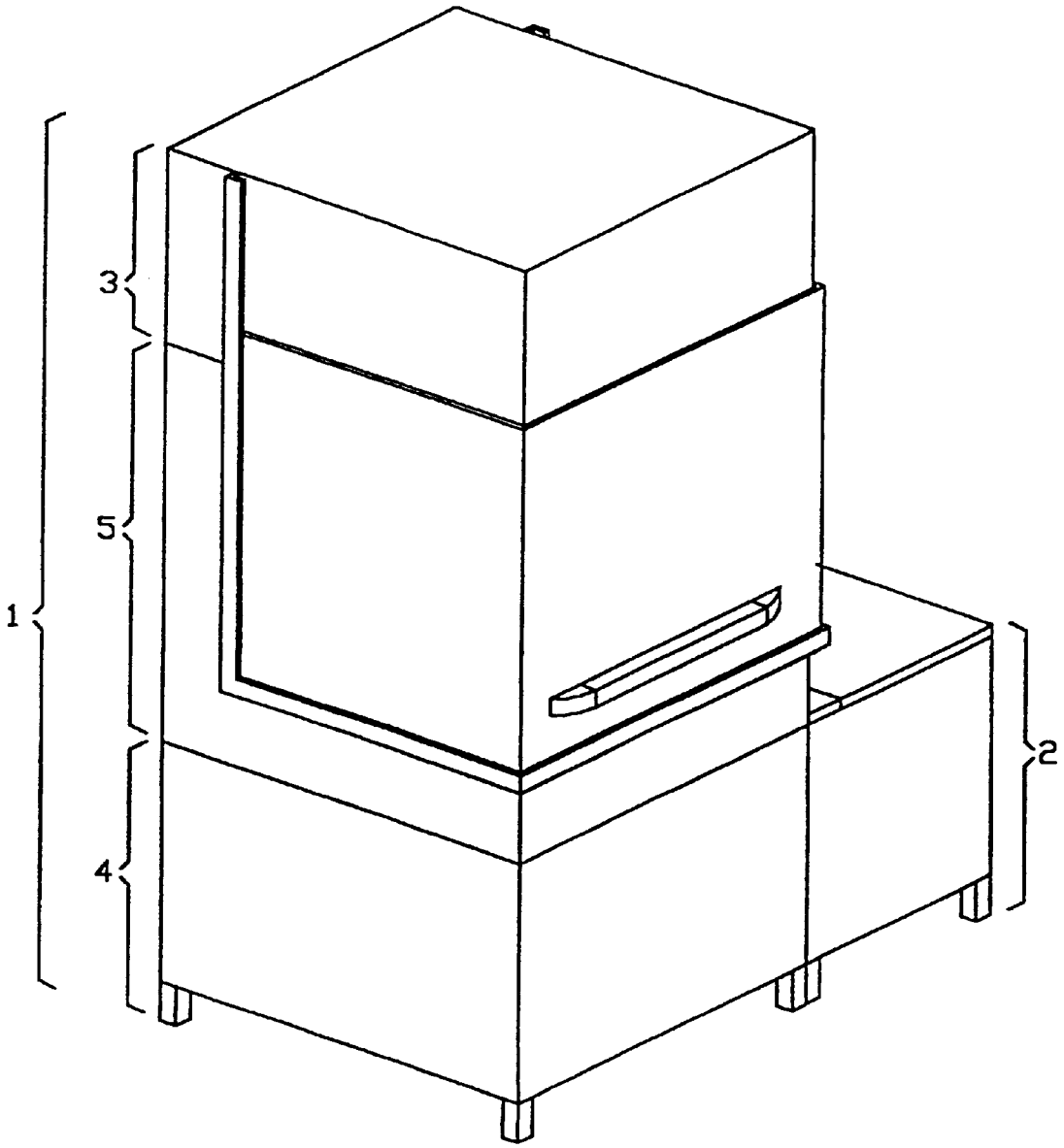
FIG. 21 shows a perspective view of another embodiment of the dishwashing machine according to the invention, where the top compartment is enlarged to accommodate a "Top-Down" dish-rack rotating mechanism and an entry cover which is modified to have a sliding mechanism and in a closed position.
Figure 22:
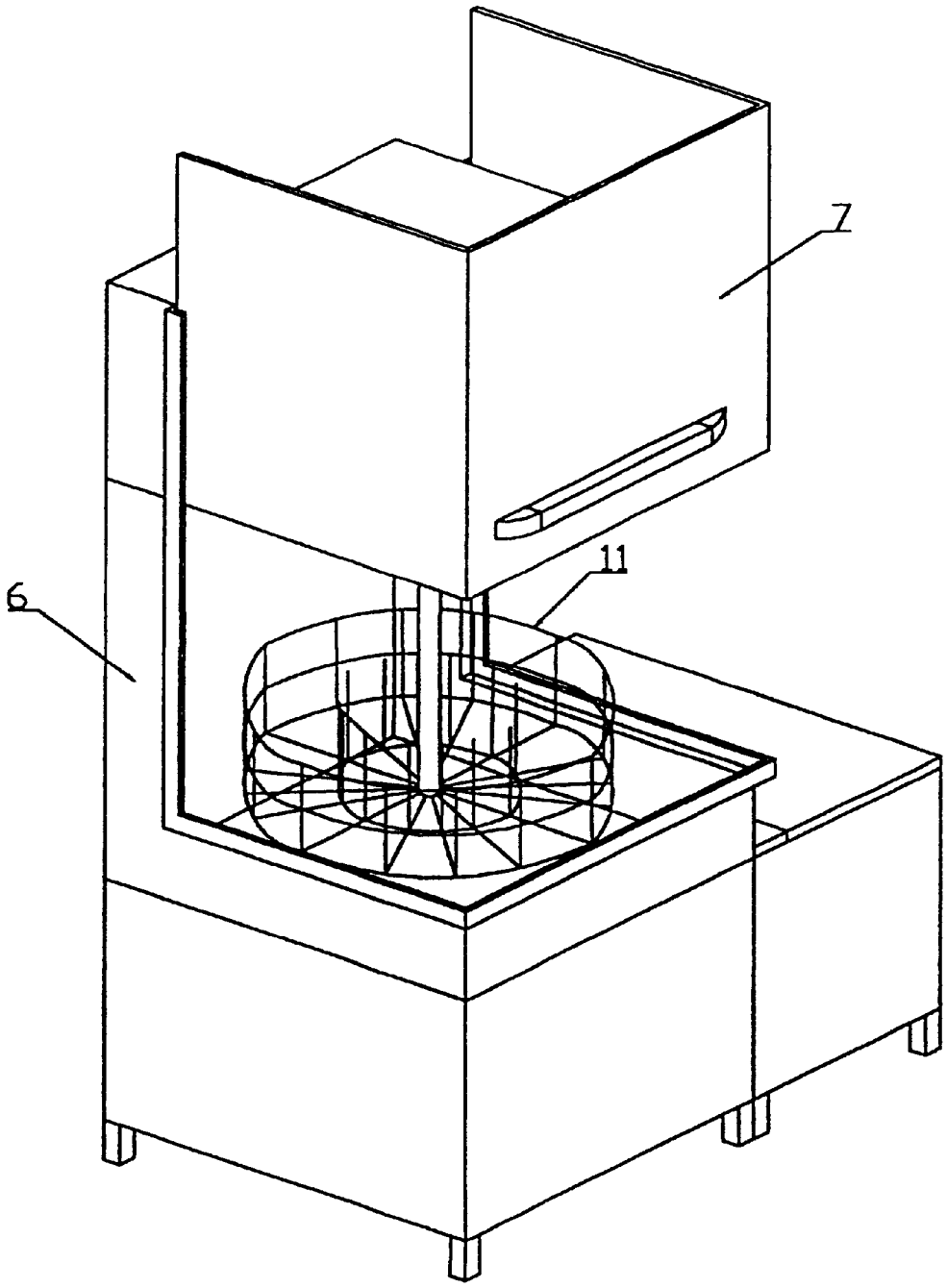
FIG. 22 shows a perspective view of the other embodiment of the dishwashing machine according to the invention, where the top compartment is enlarged and the sliding type entry cover is in an opened position.

Another embodiment of the dishwashing machine according to the invention is shown in FIGS. 21 and 22, where the top compartment is enlarged and the cover is modified to have a sliding mechanism.

Practically, the main cabinet [1] and the sub-cabinet [2] of the dishwashing machine can be merged together as a single cabinet dishwashing machine, where the space or layout of the dishwashing machine is reasonably large. In some other cases, the main cabinet [1] and the sub-cabinet [2] can be partially merged.

The dishwashing machine also has a dish-rack rotating mechanism and an "Isolated Fluid Curtain" (IFC) spraying system. In addition, a "Rotating Rack Air Curtain" (RRAC) drying system and, a "Rotating Rack Ultraviolet Light Curtain" (RRUV) sterilizing system are incorporated in the design as optional features.

Referring to FIGS. 3 to 8, a dish-rack [11] is placed on a rotating dish-rack holder [12], which is located within the dish-cleaning compartment [5]. The rotating dish-rack holder [12] is connected to a dish-rack rotating mechanism, which is drived by an electric motor [13] located at the supporting frame compartment [4].

In the invention, two types of dish-rack rotating mechanisms are recommended for the proposed dishwashing machine, which are called "Bottom-up" dish-rack rotating mechanism in one embodiment as shown in FIGS. 1–8 and "Top-Down" dish-rack rotating mechanism in another embodiment as shown in FIGS. 21–24. Basically, each of the dish-rack rotating mechanism mainly consists of an electric motor [13], a motor speed reducer mechanism [60] and a rotate-able connecting shaft [61].

Figure 3:
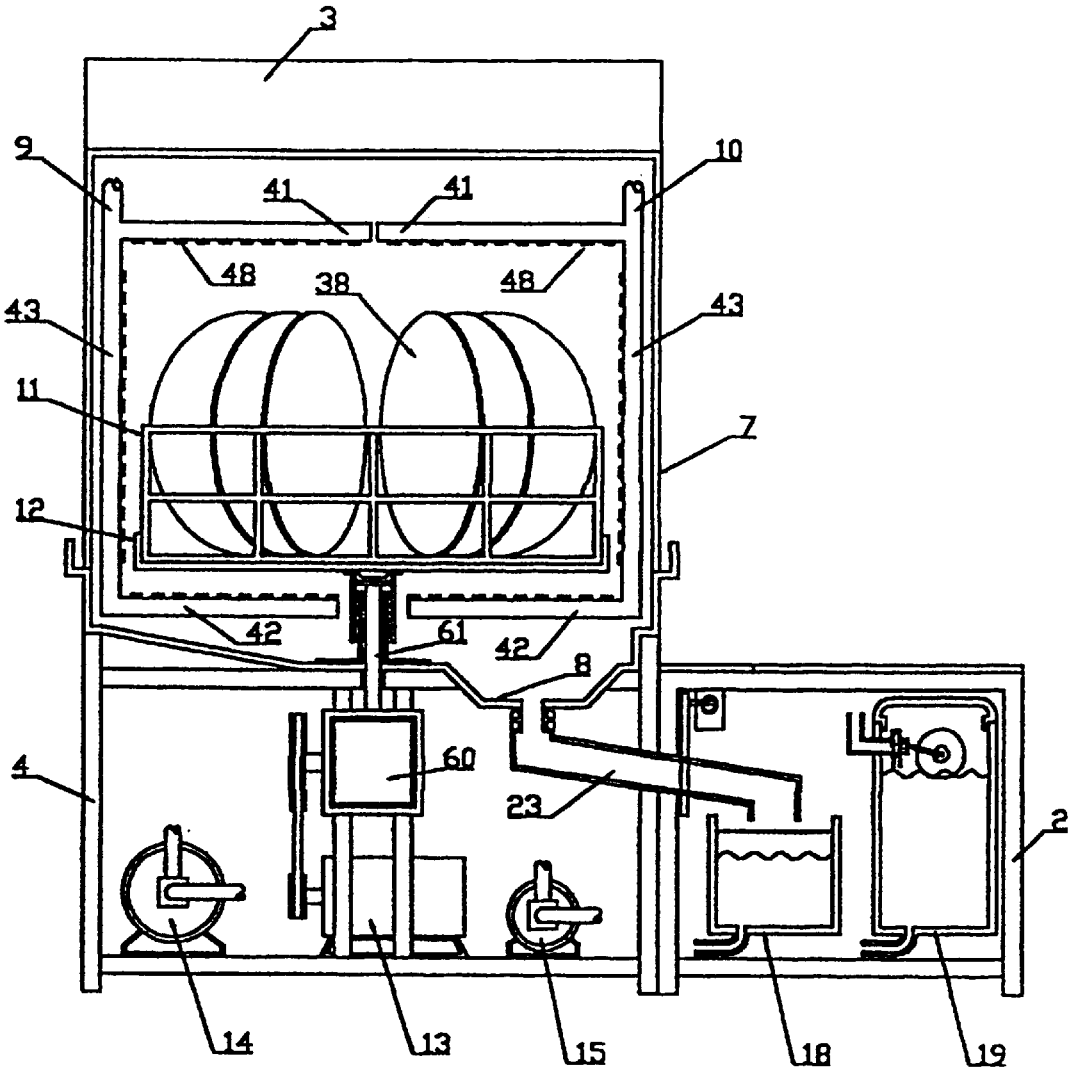
FIG. 3 shows a longitudinal vertical section through the dishwashing machine according to the invention, where a "Rotating Rack Air Curtain" structure and a "Rotating Rack Ultraviolet Light Curtain" structure are not shown.
Figure 4:
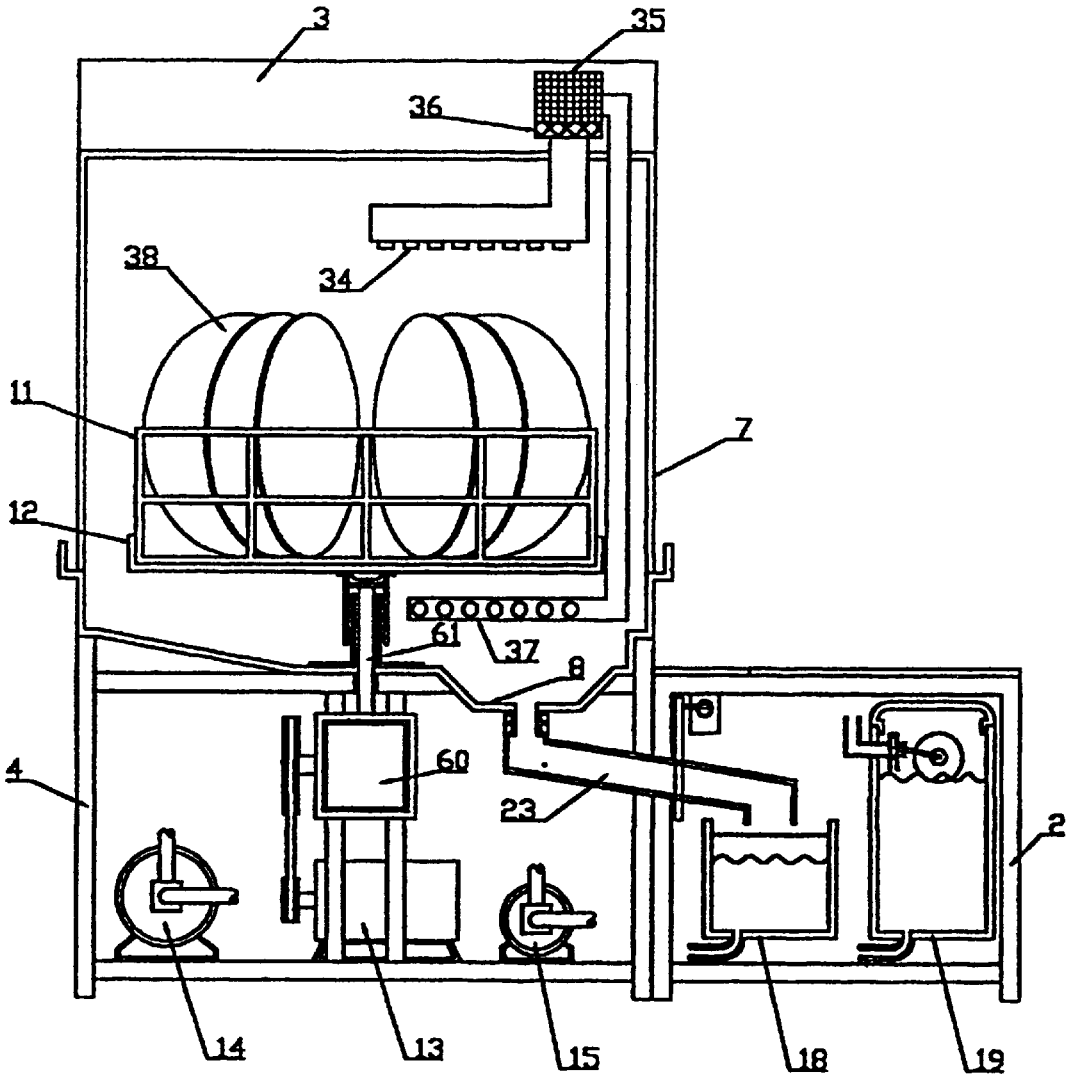
FIG. 4 shows a longitudinal vertical section through the dishwashing machine according to the invention, where a "Re-circulating and Non Re-circulating Spray Arms" structure and the "Rotating Rack Ultraviolet Light Curtain" structure are not shown.
Figure 5:
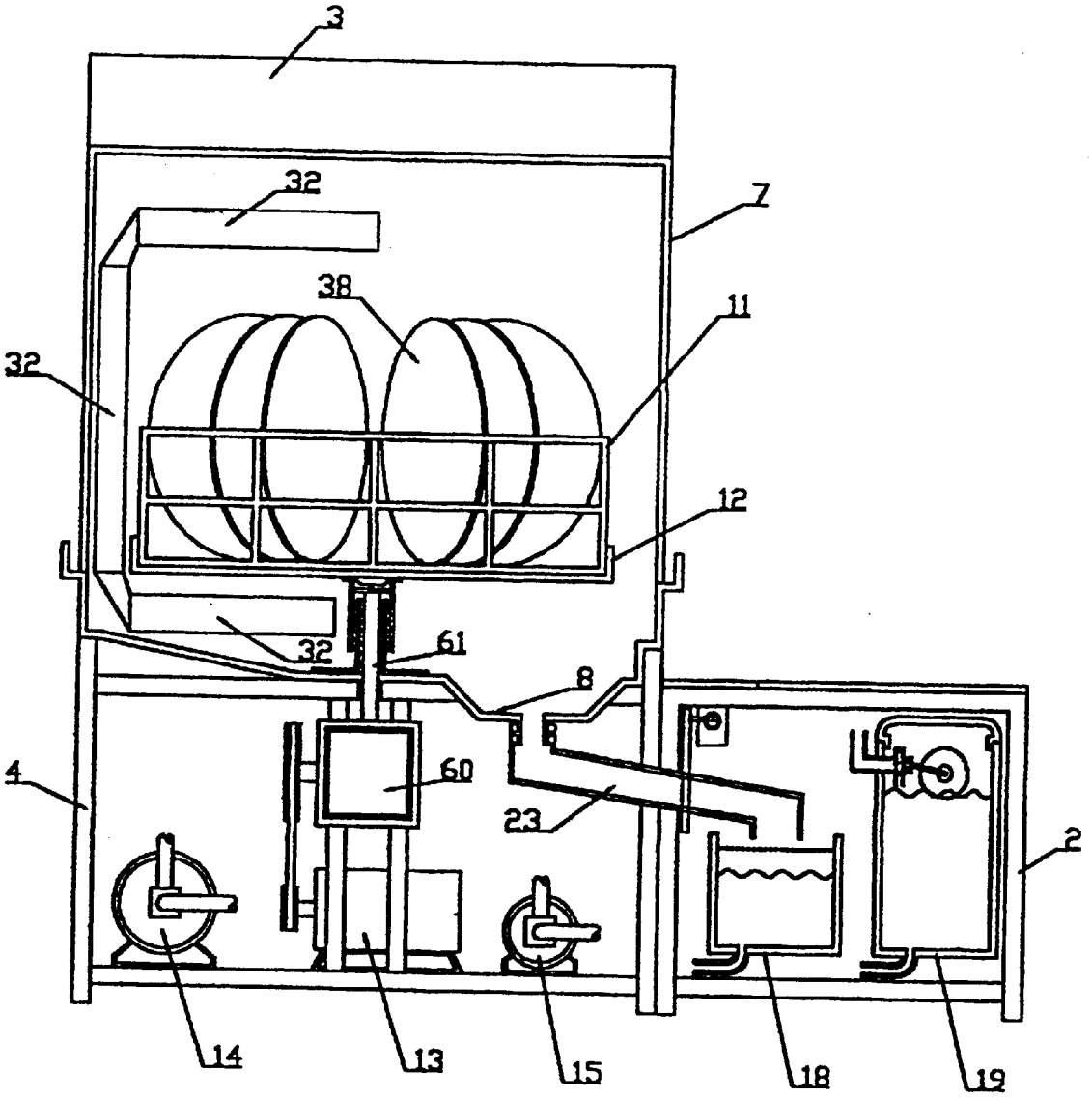
FIG. 5 shows a longitudinal vertical section through the dishwashing machine according to the invention, where the "Re-circulating and Non Re-circulating Spray Arms" structure and the "Rotating Rack Air Curtain" structure are not shown.

In the "Bottom-Up" dish-rack rotating mechanism, the electric motor [13] and the motor speed reducer mechanism [60] are located below the dish-cleaning compartment [5] as shown in FIGS. 3 to 5. The dish-rack holder [12] is located within the dish-cleaning compartment [5]. The upper end of the rotate-able connecting shaft [61] is connected to the center of the dish-rack holder [12] as shown in FIGS. 3 to 12. The lower end of the rotate-able connecting shaft [61] is connected to the motor speed reducer mechanism [60] as shown in FIGS. 3 to 5.

Figure 23:
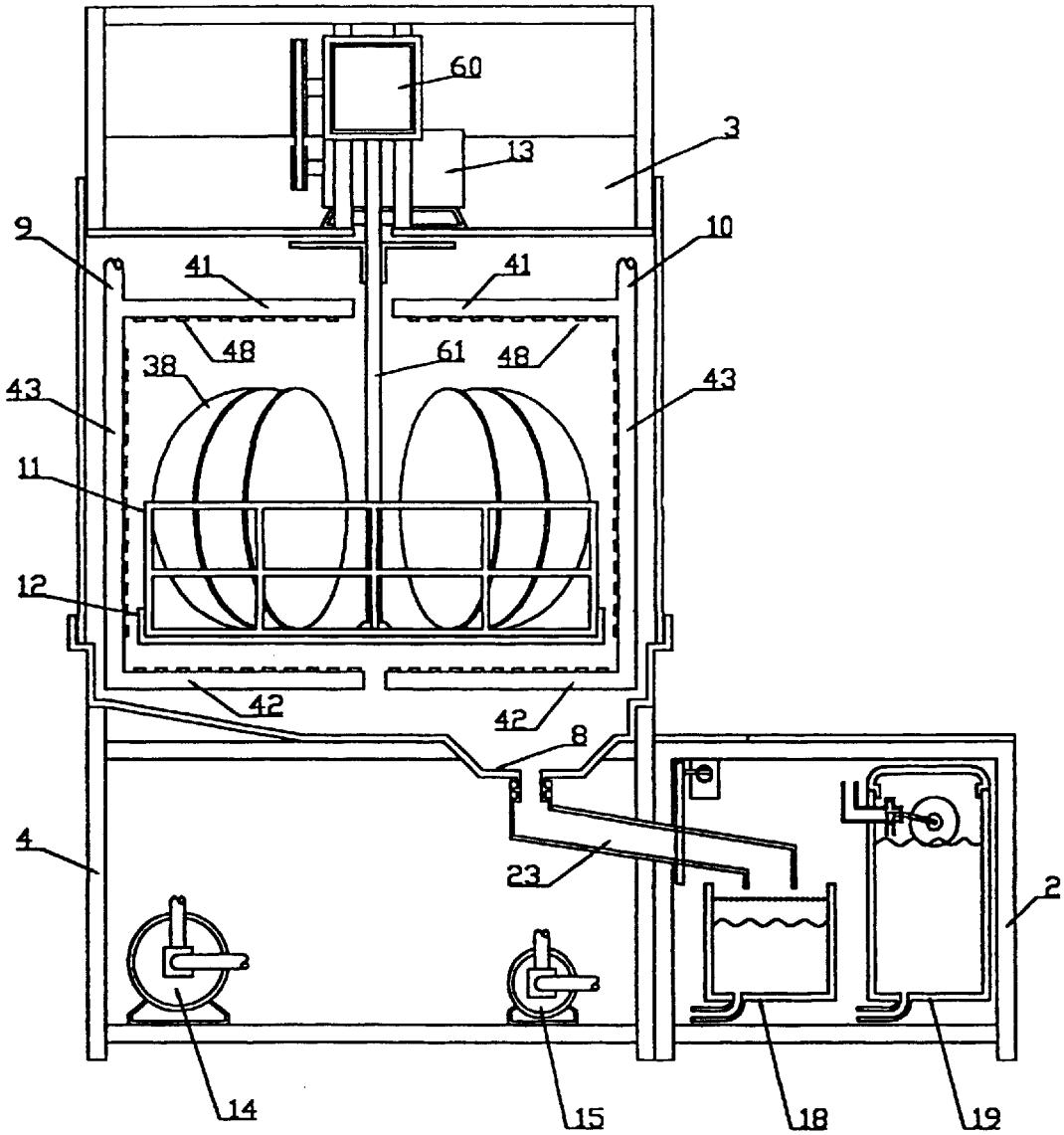
FIG. 23 shows a longitudinal vertical section through the other embodiment of the dishwashing machine according to the invention, where the top compartment is enlarged to accommodate the "Top-Down" dish-rack rotating mechanism and the sliding type entry cover where the "Rotating Rack Air Curtain" structure and the "Rotating Rack Ultraviolet Light Curtain" structure are not shown.
Figure 24:
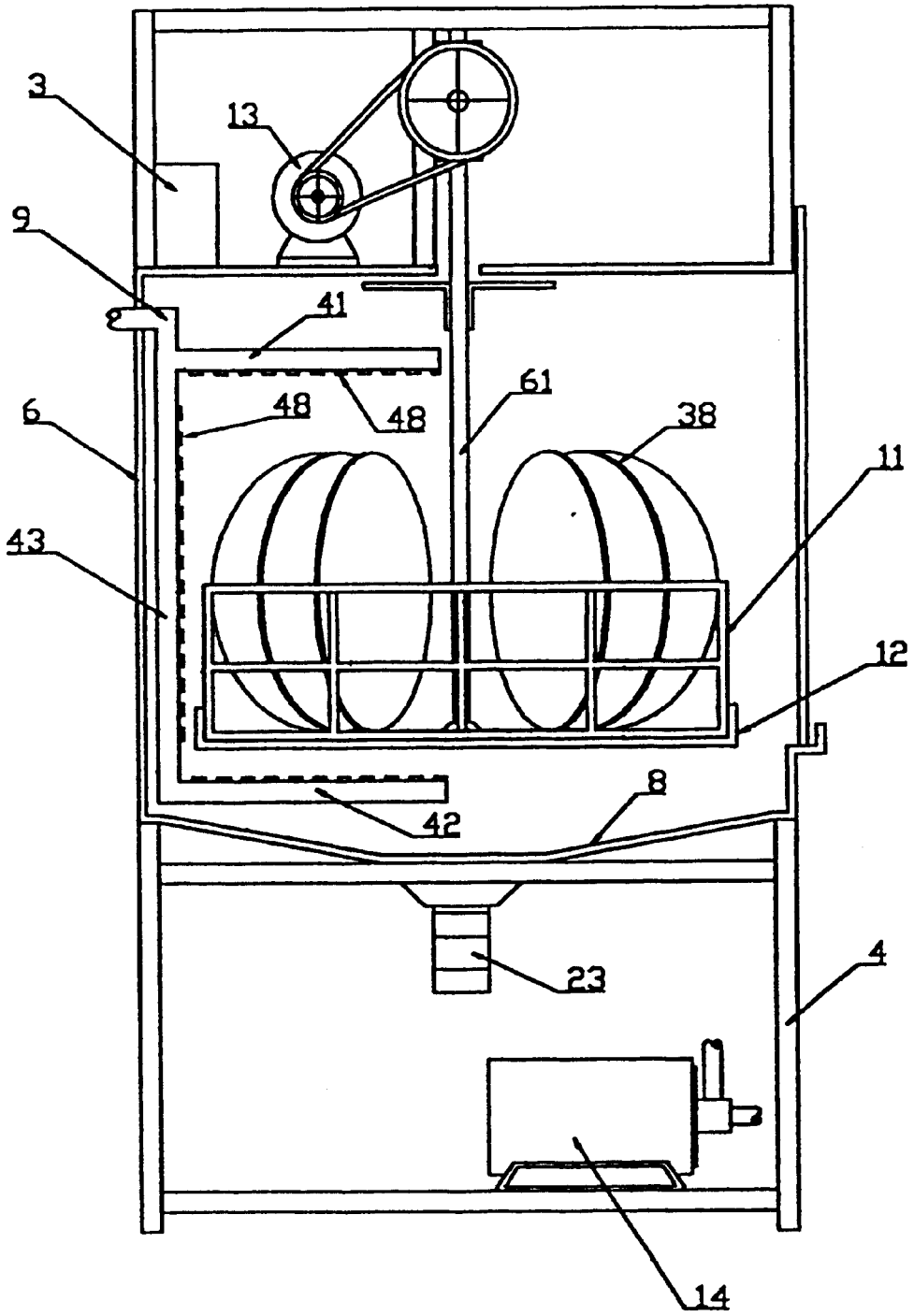
FIG. 24 shows a transverse vertical section through the main cabinet of the other embodiment of the dishwashing machine according to the invention, where the top compartment is enlarged to accommodate "Top-Down" dish-rack rotating mechanism and the sliding type entry cover where the "Rotating Rack Air Curtain" structure and the "Rotating Rack Ultraviolet Light Curtain" structure are not shown.

In the "Top-Down" dish-rack rotating mechanism, the electric motor [13] and the motor speed reducer mechanism [60] are located above the dish-cleaning compartment [5] as shown in FIG. 23. The dish-rack holder [12] is located within the dish-cleaning compartment [5]. The lower end of the rotateable connecting shaft [61] is connected to the center of the dish-rack holder [12], while the upper end of the rotateable connecting shaft [61] is connected to the motor speed reducer mechanism [60] as shown in FIG. 23.

Two fluid pumps are stationed at the supporting frame compartment [4] as shown in FIGS. 3, 4, 5 and 23. The first fluid pump is used as a re-circulating fluid pump [14] and the second fluid pump is used as a non re-circulating fluid pump [15]. A relatively higher flow rate fluid pump is used as a re-circulating fluid pump [14] to create a strong scraping force of on the soiled dishes [38]. The strong scraping force of the high flow rate re-circulating fluid greatly improved the overall washing efficiency.

One of the unique features of the invention is a spraying system called "Isolated Fluid Curtain" (IFC) spraying system. Conceptually, the "Isolated Fluid Curtain" spraying system is formed by a plurality of isolated fluid curtains, which include a "Re-circulating Fluid Curtain" and a "Non Re-circulating Fluid Curtain". The "Isolated Fluid Curtain" spraying system has two isolated spraying systems, which are re-circulating fluid spraying system and non re-circulating fluid spraying system. A re-circulating fluid spray arm and a non re-circulating fluid spray arm are used in the re-circulating fluid spraying system and the non re-circulating fluid spraying respectively. The re-circulating fluid spray arm and non re-circulating fluid spray arm are further equipped with a plurality of "water-jet-holes" or nozzles [48]. The plurality of "water-jet-holes" or nozzles [48] are located along the re-circulating fluid spray arm and non re-circulating spray arm as shown in FIGS. 3, 6, 9, 10, 11 and 12. The layout and design of the "water-jet-holes" or nozzles is meant to form multiple angles "Fluid Curtain" spraying pattern when fluid is sprayed through the "water-jet-holes" or nozzles. Basically, the multiple angles "Fluid Curtain" spraying pattern involves multiple spraying angles from top, bottom and side(s) of a targeted object at a specific location. The "Re-circulating Fluid Curtain" is generated by fluid spraying from the re-circulating fluid spray arm while the "Non Re-circulating Fluid Curtain" is created by fluid spraying from the non re-circulating fluid spray arm.

A significant advantage of the "Isolated Fluid Curtain" spraying system design is the capability and efficiency to minimize the cross contamination of the re-circulating fluid and non re-circulating fluid by isolating the re-circulating fluid and non re-circulating fluid flow in two separate spray arms, piping and pumping systems.

The spray arm design of the "Isolated Fluid Curtain" spraying system is largely depended on the dishwashing machine's dish-rack loading system.

Figure 9:
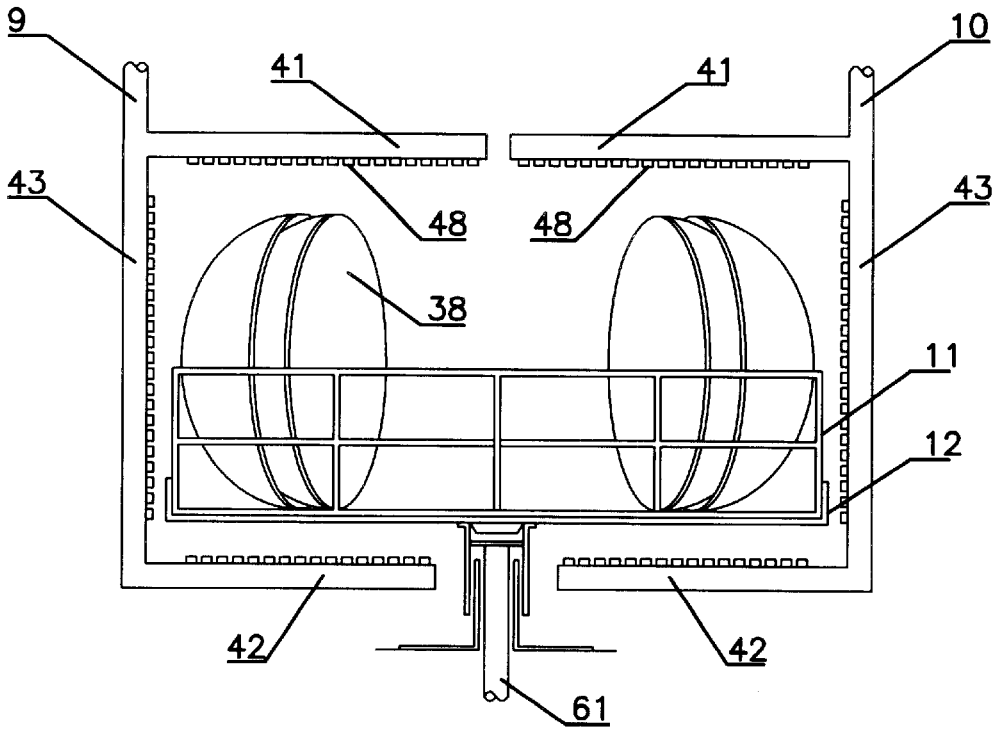
FIG. 9 shows a front view of a single level "Type-C" non re-circulating spray arm, a single level "Type-C" re-circulating spray arm and a rotating dish-rack arrangement according to the invention.
Figure 10:
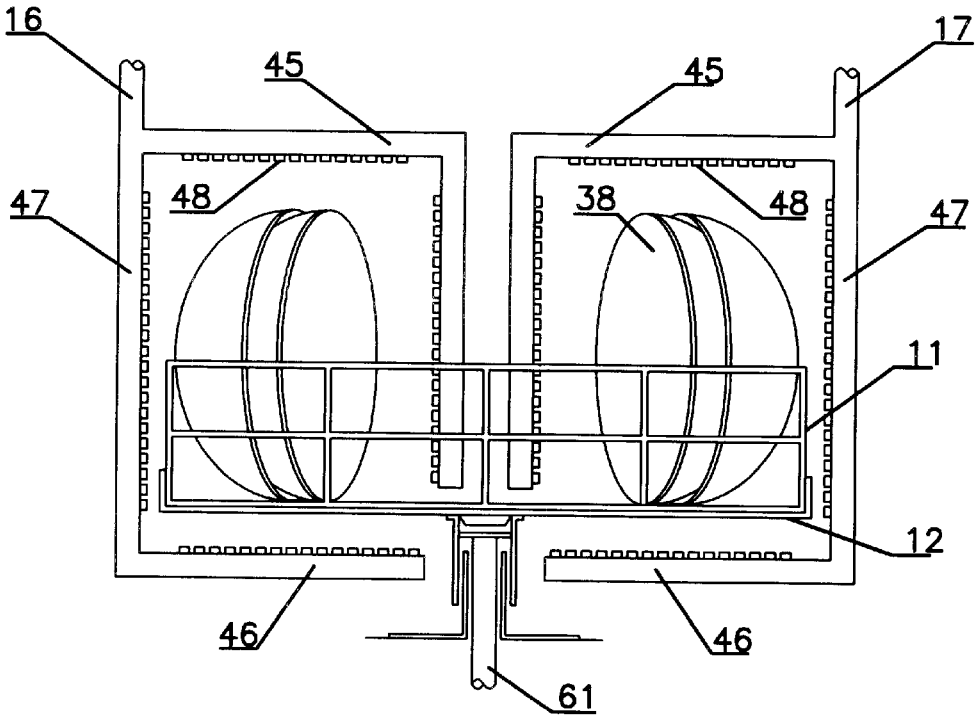
FIG. 10 shows a front view of a single level "Type-D" non re-circulating spray arm, a single level "Type-D" re-circulating spray arm and a rotating dish-rack arrangement according to the invention.
Figure 11:
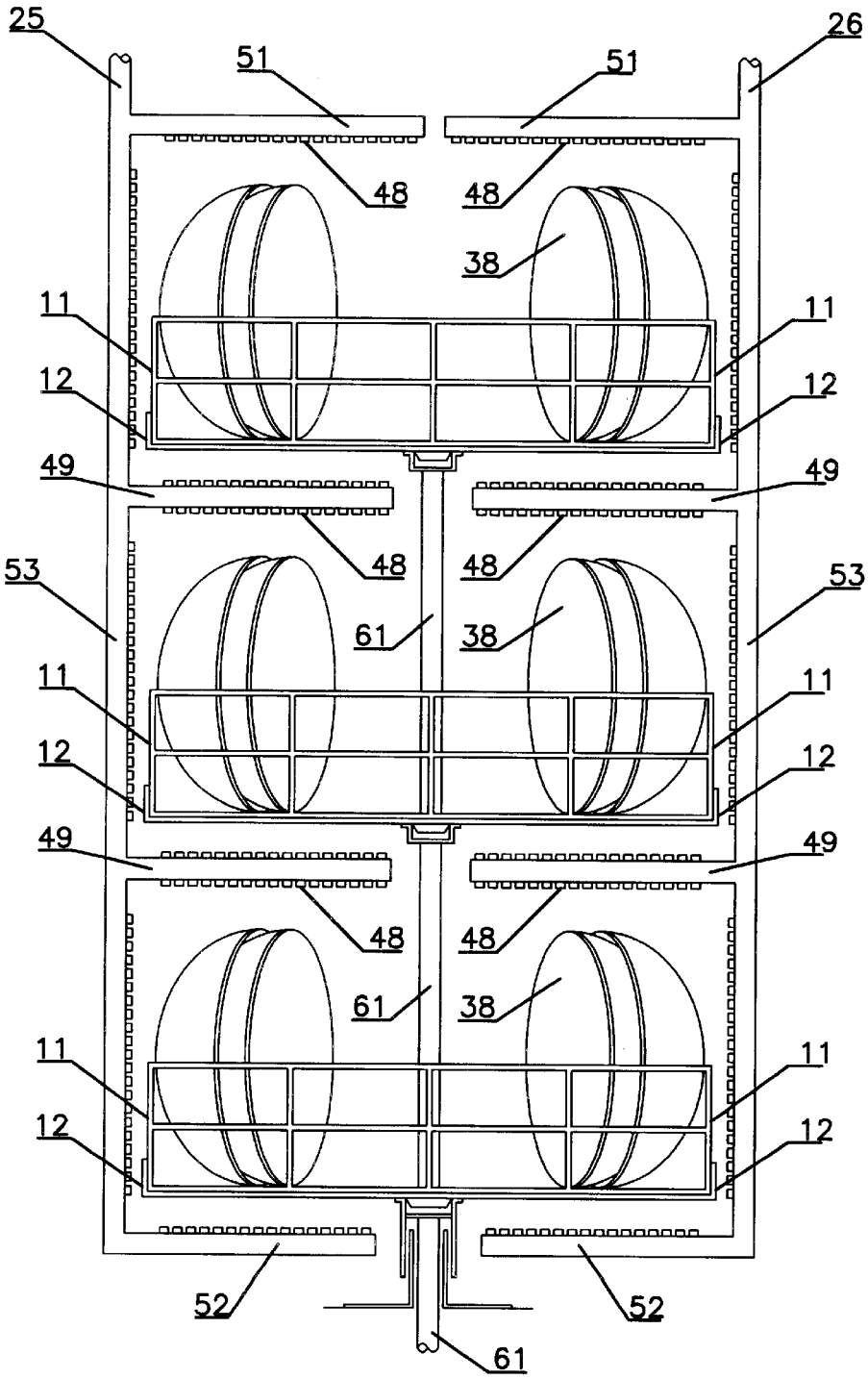
FIG. 11 shows a front view of a multilevel "Type-C" non re-circulating spray arm, a multilevel "Type-C" re-circulating spray arm and a multiple rotating dish-rack arrangement according to the invention.
Figure 12:
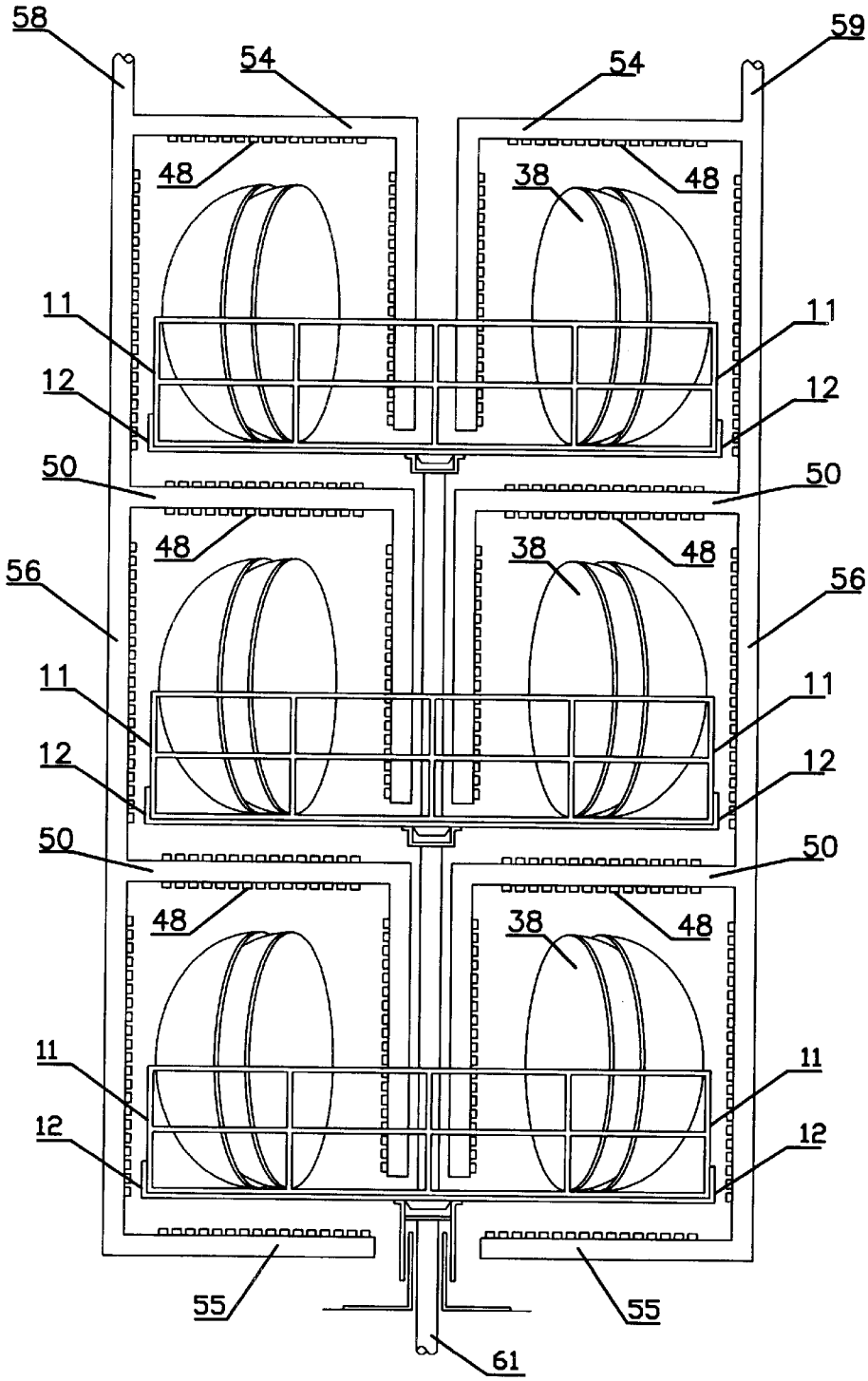
FIG. 12 shows a front view of a multilevel "Type-D" non re-circulating spray arm, a multilevel "Type-D" re-circulating spray arm and a multiple rotating dish-rack arrangement according to the invention.

Technically, two types of dish-rack loading system are proposed in the invention, which are single level dish-rack loading system as shown in FIGS. 3–10 and FIGS. 23–24 and multilevel dish-rack loading system as shown in FIGS. 11 & 12. The single level dish-rack loading system is only capable to process one level of loaded dish-rack in each dishwashing cycle while the multilevel dish-rack loading system is capable to process a plurality of levels of loaded dish-racks in each dishwashing cycle. In the single level dish-rack loading system, two types of spray arm designs are proposed for the "Isolated Fluid Curtain" spraying system, which are "Single Level Type-C" spray arm and "Single Level Type-D" spray arm.

Figure 6:
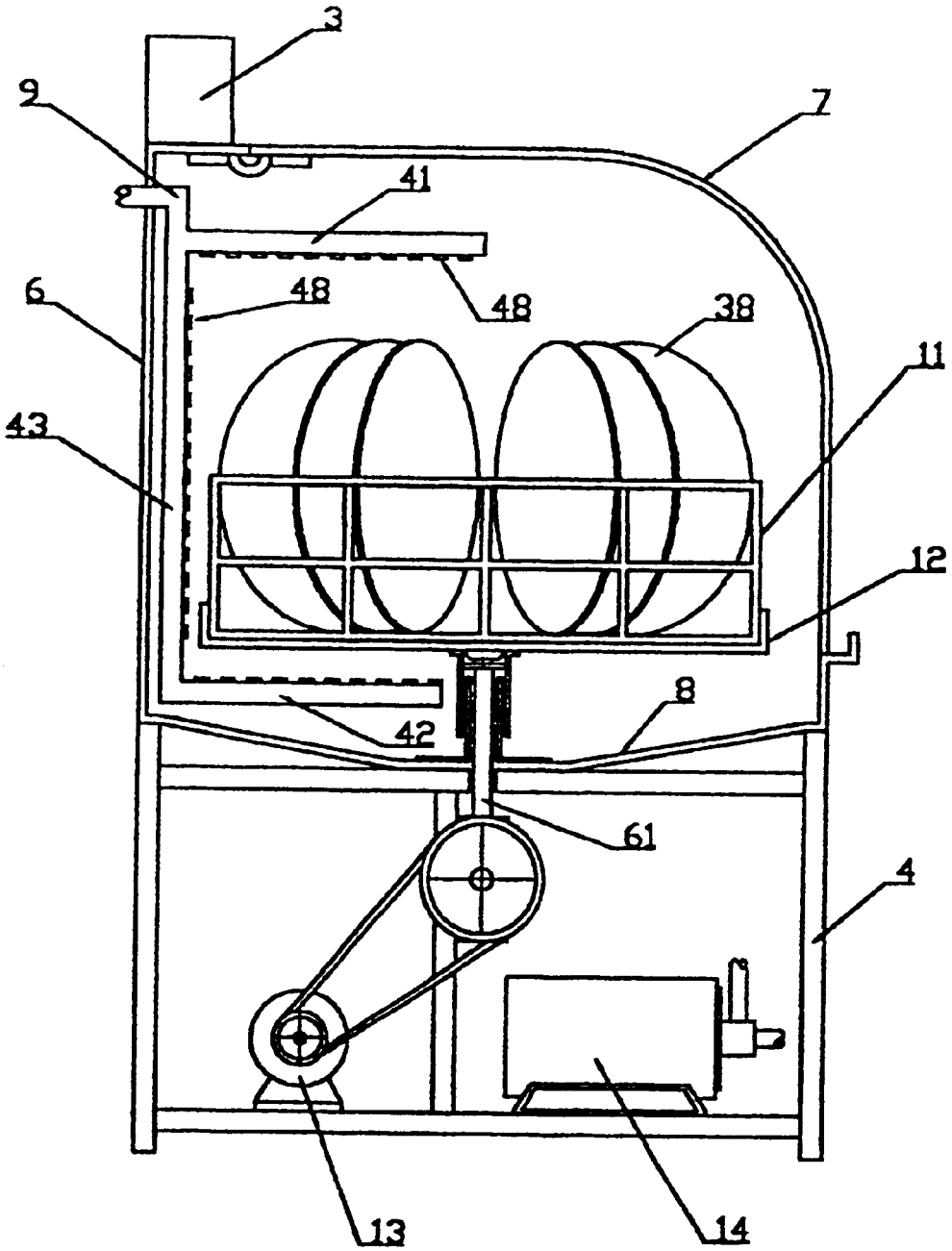
FIG. 6 shows a transverse vertical section through a main cabinet of the dishwashing machine according to the invention, where the "Rotating Rack Air Curtain" structure and the "Rotating Rack Ultraviolet Light Curtain" structure are not shown.

The "Single Level Type-C" spray arm has a "Single Level Type-C" re-circulating and non re-circulating fluid spray arms [9], [10] as shown in FIGS. 3, 6 and 9. The piping of the "Single Level Type-C" re-circulating fluid spray arm [9] and the "Single Level Type-C" non re-circulating fluid spray arm [10] are placed from a location above the loaded dish-rack [11] to a location below the rotating dish-rack holder [12] through the "outer diameter" side of the rotating dish-rack holder [12] as shown in FIG. 3.

Basically, the "Single Level Type-C" spray arm has a "Single level Type-C Upper Arm" [41], a "Single level Type-C Lower Arm" [42] and a "Single Level Type-C side Arm" [43] as shown in FIGS. 3, 6 and 9. The "Single Level Type-C Upper Arm" [41] and a "Single Level Type-C Lower Arm" [42] are connected to the upper end and lower end of the "Single Level Type-C Side Arm" [43] respectively. Generally, in the "Single Level Type-C" spray arm design, the "Single Level Type-C Upper Arm" [41] is longer than the "Single Level Type-C Lower Arm" [42]. The longer "Single Level Type-C Upper Arm" design is to improve the spray coverage at the center of the rotating dish-rack holder [12].

In order to fulfill an all angle spray concept for a single level dish-rack loading system, another improved spray arm design is proposed in the invention, which is called a "Single Level Type-D" spray arm as shown in FIG. 10. The "Single Level Type-D" spray arm also has a re-circulating spray arm and a non re-circulating spray arm. The "Single Level Type-D" re-circulating spray arm [16] and "Single Level Type-D" non re-circulating spray arm [17] extend their upper arm piping vertically downward to the center of the rotating dish-rack holder [12] as shown in FIG. 10. Basically, the "Single Level Type-D" spray arm has an extended "Single Level Type-D Upper Arm" [45], a "Single Level Type-D Lower Arm" [46] and a "Single Level Type-D Side Arm" [47] as shown in FIG. 10. The extended "Single Level Type-D" Upper Arm [45] provides extra spray coverage from the center of the rotating dish-rack [11]. Generally, the "Single Level Type-D" spray arm design is mainly designed for dishwashing machine which has a large dish-cleaning compartment.

For the multilevel dish-rack loading system, the design of the "Single level Type-C" spray arm and the "Single Level Type-D" spray arms are further modified to become "Multilevel Type-C" spray arms and "Multilevel Type-D" spray arms as shown in FIG. 11 and FIG. 12 respectively.

In the multilevel dish-rack loading system, two types of spray arms are introduced in the "Isolated Fluid Curtain" spraying system, which are "Multilevel Type-C" spray arm and "Multilevel Type "D" spray arm.

The "Multilevel Type-C" spray arm has a "Multilevel Type-C" re-circulating spray arm [25] and a "Multilevel Type-C" non re-circulating spray arm [26] as shown in FIG. 11. The piping of both "Multilevel Type-C" re-circulating spray arm [25] and "Multilevel Type-C" non re-circulating spray arm [26] are placed at locations as shown in FIG. 11. Basically, the "Multilevel Type-C" spray arm has a "Multilevel Type-C Upper Arm" [51],a "Multilevel Type-C Lower Arm" [52], a "Multilevel Type-C Side Arm" [53] and a plurality of "Multilevel Type-C Extra Arms" [49] as shown in FIG. 11. The "Multilevel Type-C Upper Arm" [51] and "Multilevel Type-C Lower Arm" [53] are connected to the upper end and lower end of the "Multilevel Type-C Side Arm" respectively. The number of "Multilevel Type-C Extra Arms" needed depends on the number of extra levels introduced. In addition, an optional oscillating mechanism is proposed for both "Single Level Type-C" spray arm and "Multilevel Type-C" spray arm to provide a pivot-able swing water jet.

In order to fulfill an all angle spray concept for multilevel dish-rack loading system, another improved spray arm design is proposed in the invention, which is called "Multilevel Type-D" spray arms. The "Multilevel Type-D" spray arm also has a "Multilevel Type-D" re-circulating spray arm [58] and a "Multilevel Type-D" non re-circulating spray arm [59] as shown in FIG. 12. Basically, the "Multilevel Type-D" spray arm has a "Multilevel Type-D Upper Arm" [54], a "Multilevel Type-D Lower Arm" [55], a "Multilevel Type-D Side Arm" [56] and a plurality of "Multilevel Type-D Extra Arm" [50] as shown in FIG. 12. The "Multilevel Type-D Extra Arm" [50] are equipped with extra nozzles, which provide an extra spray coverage between different level of rotating dish-rack [11] as shown in FIG. 12. The number of "Multilevel Type-D Extra Arm" [50] needed also depends on the number of extra level introduced. Generally, the "Multilevel Type-D" spray arm design is mainly used in the dishwashing machine which has a large dish-cleaning compartment as well as a multilevel dish-rack loading system.

Figure 15:
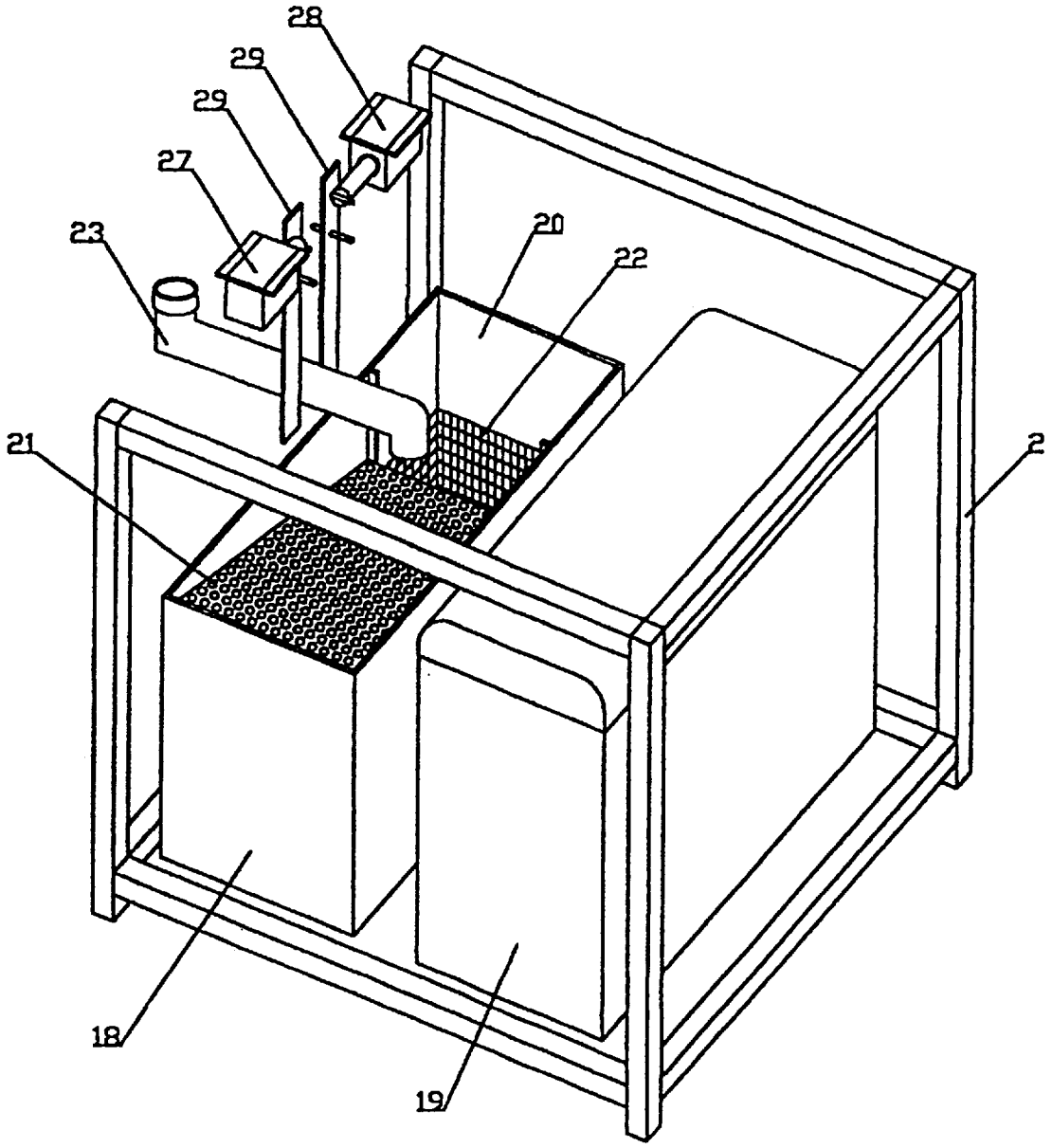
FIG. 15 shows a perspective view of a rotate-able drain pipe, a "Dual Solenoid Drainage Mechanism" structure, a non re-circulating fluid tank, a re-circulating fluid tank and a waste filter tank arrangement at a sub-cabinet according to the invention.
Figure 16:
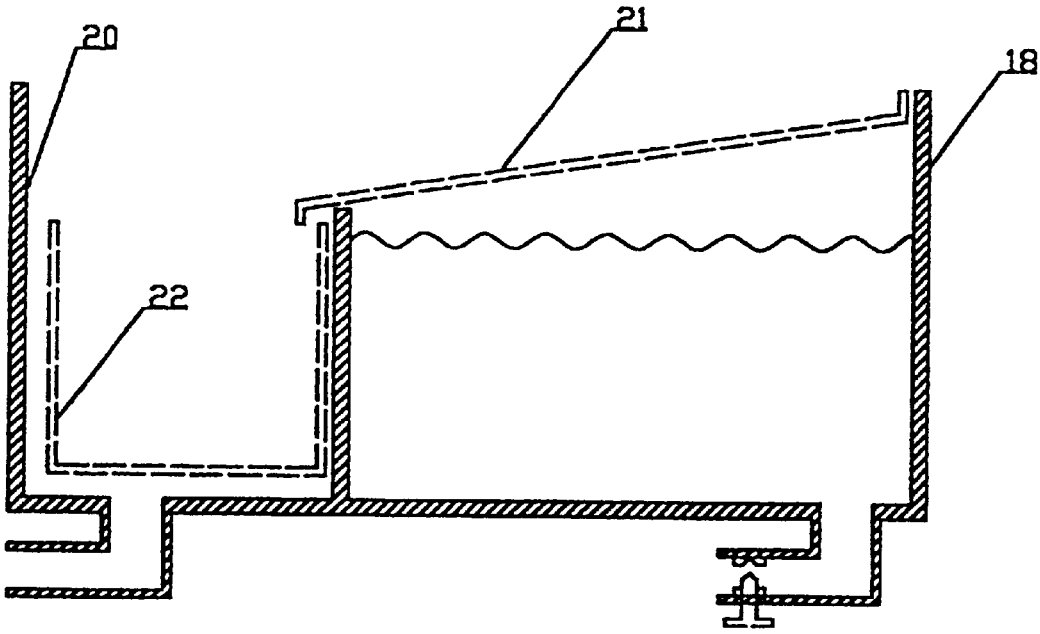
FIG. 16 shows a vertical section through the re-circulating fluid tank and the waste filter tank at the sub-cabinet according to the invent on, where the structural re-circulating fluid tank and waste filter tank are partially combined.

Referring to FIG. 15, the sub-cabinet [2] basically includes a re-circulating fluid tank [18], a non re-circulating fluid tank [19], a waste filter tank [20] and a casing base's drainage mechanism. In addition, a water heating system can be incorporated in the re-circulating fluid tank [18] and non re-circulating fluid tank [19] as an optional feature. Referring to FIG. 15 and FIG. 16, the re-circulating fluid tank [18] and the waste filter tank [20] can be combined as a double compartment container. A removable slanted filtering net [21] is attached to the re-circulating fluid. The waste filter tank [20] is equipped with a removable waste gathering basket [22], which is located near the lower end of the slanted filtering net [21]. The waste gathering basket [22] is relatively large and is meant to accumulate the food residue or waste for a relatively long period of time. On the other hand, the non re-circulating fluid tank [19] is also equipped with a filter to safeguard the quality of non re-circulating fluid.

Basically, two types of casing base's drainage mechanism are proposed in the invention. As referring to FIG. 13 and FIG. 14, a uniquely designed rotate-able "L" shaped piping is proposed as a rotate-able drain pipe [23]. The upper opening of the rotate-able drain pipe [23] is connected to the outlet of the casing base [8]. Generally, the rotateable drain pipe [23] is designed to rotate in an angle less than 180° . The rotate-able drain pipe [23] is incorporated in both the proposed drainage mechanism design.

Figure 13:
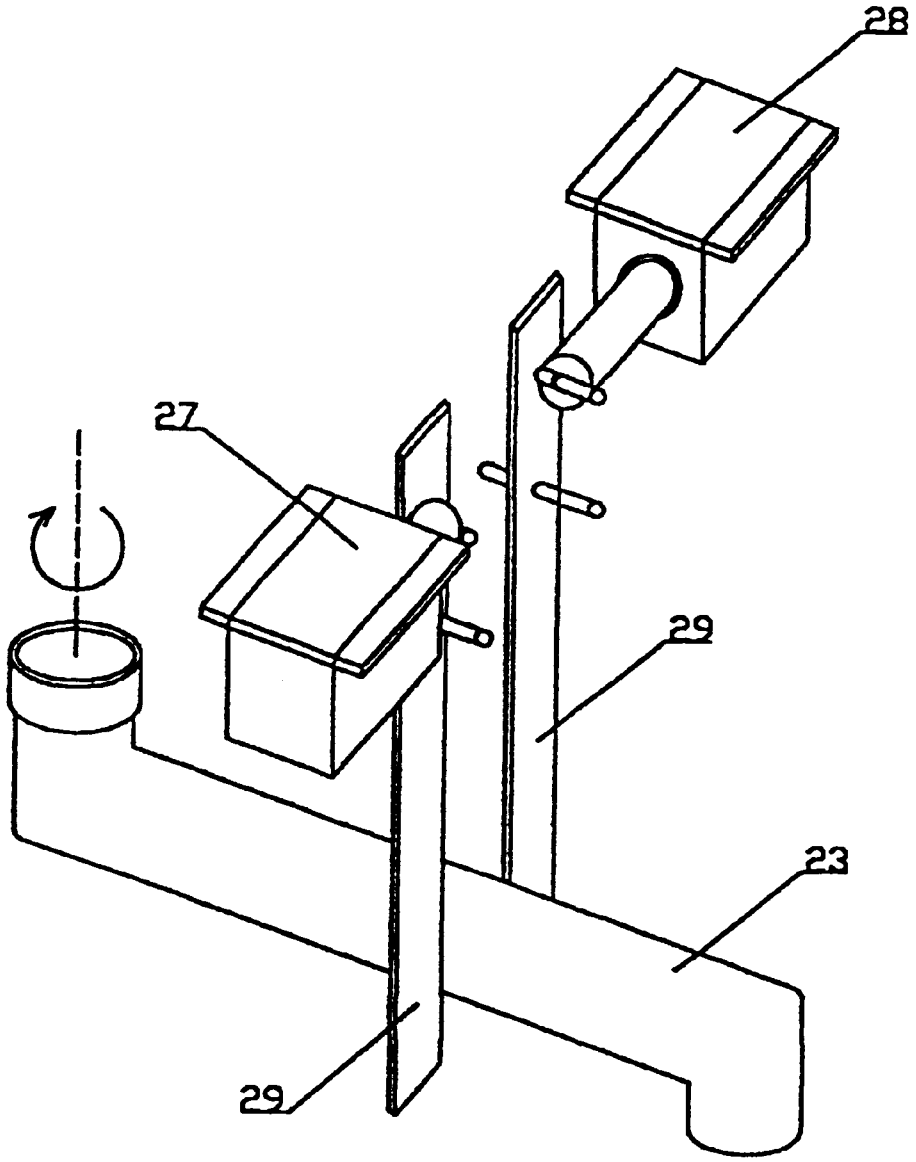
FIG. 13 shows a perspective view of a rotate-able drain pipe and a "Dual Solenoid Drainage Mechanism" arrangement according to the invention.

The first type of drainage mechanism is called "Dual Solenoid Drainage Mechanism". A perspective view of the "Dual Solenoid Drainage Mechanism" is shown in FIG. 13. Basically, the "Dual Solenoid Drainage Mechanism" has two electrically activated solenoids [27 & 28], a pivoted "Dual Solenoid Parallel Plate" [29] and a rotate-able drain pipe [23]. The drain pipe [23] is rotate-able in clockwise and anti-clockwise direction. Only one of the solenoids of "Dual Solenoid Drainage Mechanism" will be activated at a time. When the first solenoid [27] of the "Dual Solenoid Drainage Mechanism" is activated, one of the upper end of the "Dual Solenoid Parallel Plate" [29] will be pulled toward the first solenoid [27]. Referring to FIG. 13, while the upper end of the "Dual, solenoid Parallel Plate" moves toward the first solenoid [27], the lower end of the "Dual Solenoid Parallel Plate" will move away from the first solenoid [27] as the "Dual Solenoid Parallel Plate" is pivoted. Eventually, when the lower end of the "Dual Solenoid Parallel Plate" is moving away from the first solenoid, it will then push the lower end of the rotate-able drain pipe [23] away from the first solenoid [27]. On the other hand, when the second solenoid [28] of the "Dual Solenoid Drainage Mechanism" is activated, the reverse mechanism movement of the "Dual Solenoid Parallel Plate" will force the lower end of the rotate-able drain pipe [23] to move in reverse direction.

Figure 14:
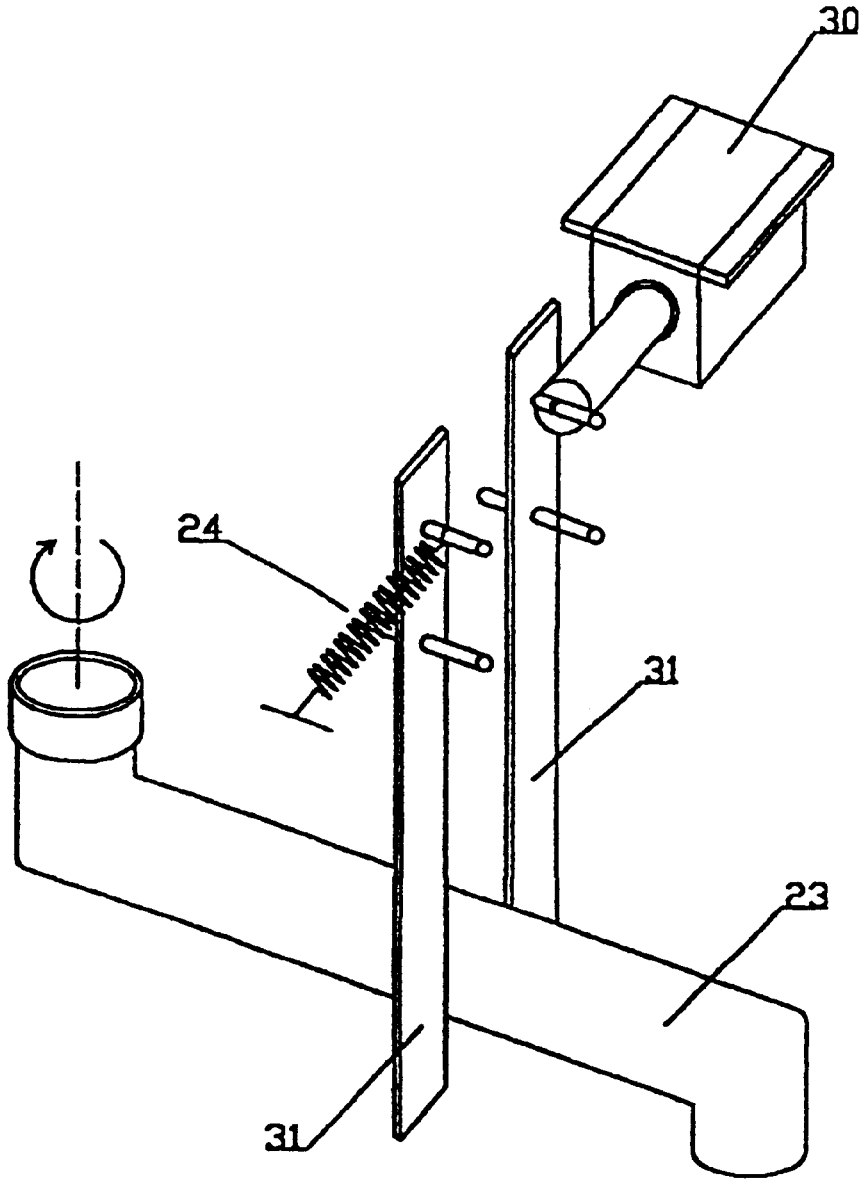
FIG. 14 shows a perspective view of a rotate-able drain pipe and a "Single Solenoid Drainage Mechanism" arrangement according to the invention.

The second type of drainage mechanism is called "Single Solenoid Drainage Mechanism", which is recommended as an optional low cost drainage mechanism. Referring to FIG. 14, the "Single Solenoid Drainage Mechanism" has a solenoid [30], a "Single Solenoid Parallel Plate" [31] structure and a resilient means [24]. The "Single Solenoid Drainage Mechanism" utilizes the "return" potential force of the resilient means e.g. a spring, a rubber band or other elastic material to "return" the drain pipe [23] to it's original position after the solenoid [30] of the "Single Solenoid Drainage Mechanism" is de-activated. Generally, the operating steps or method of the "Single Solenoid Drainage Mechanism" is similar to the "Dual solenoid Drainage Mechanism" except that the operation of the first solenoid [27] of "Dual Solenoid Drainage Mechanism" is replaced by the resilient means [24].

Figure 17:
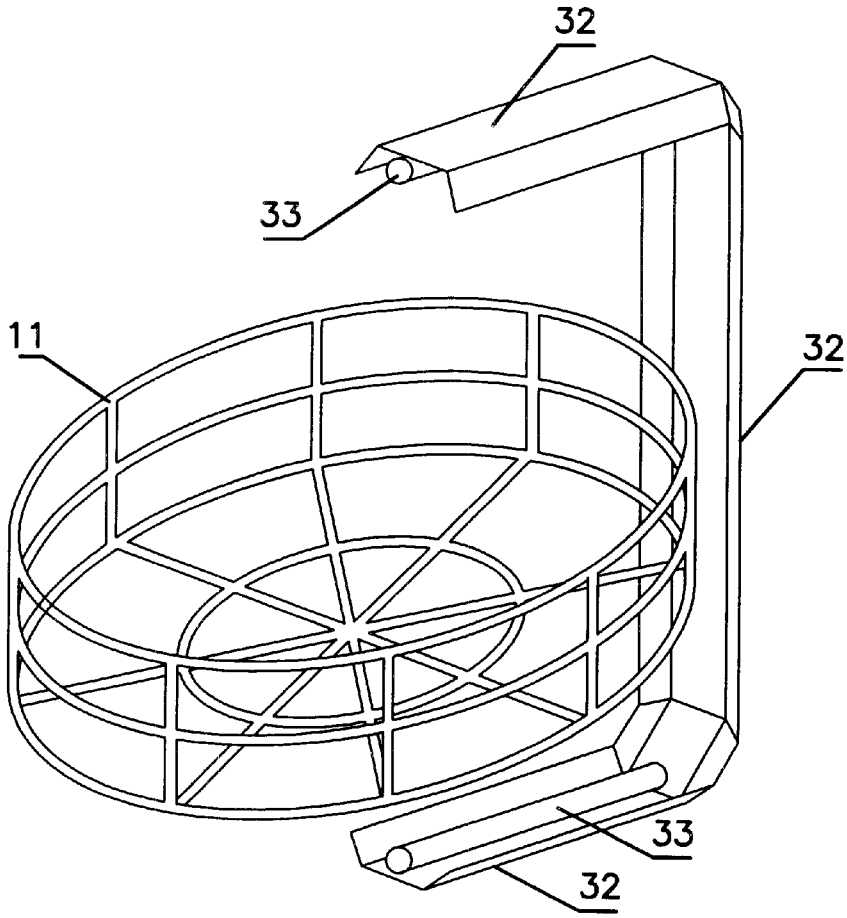
FIG. 17 shows a perspective view of a "Ultraviolet Light Curtain" layout according to the invention.
Figure 18:
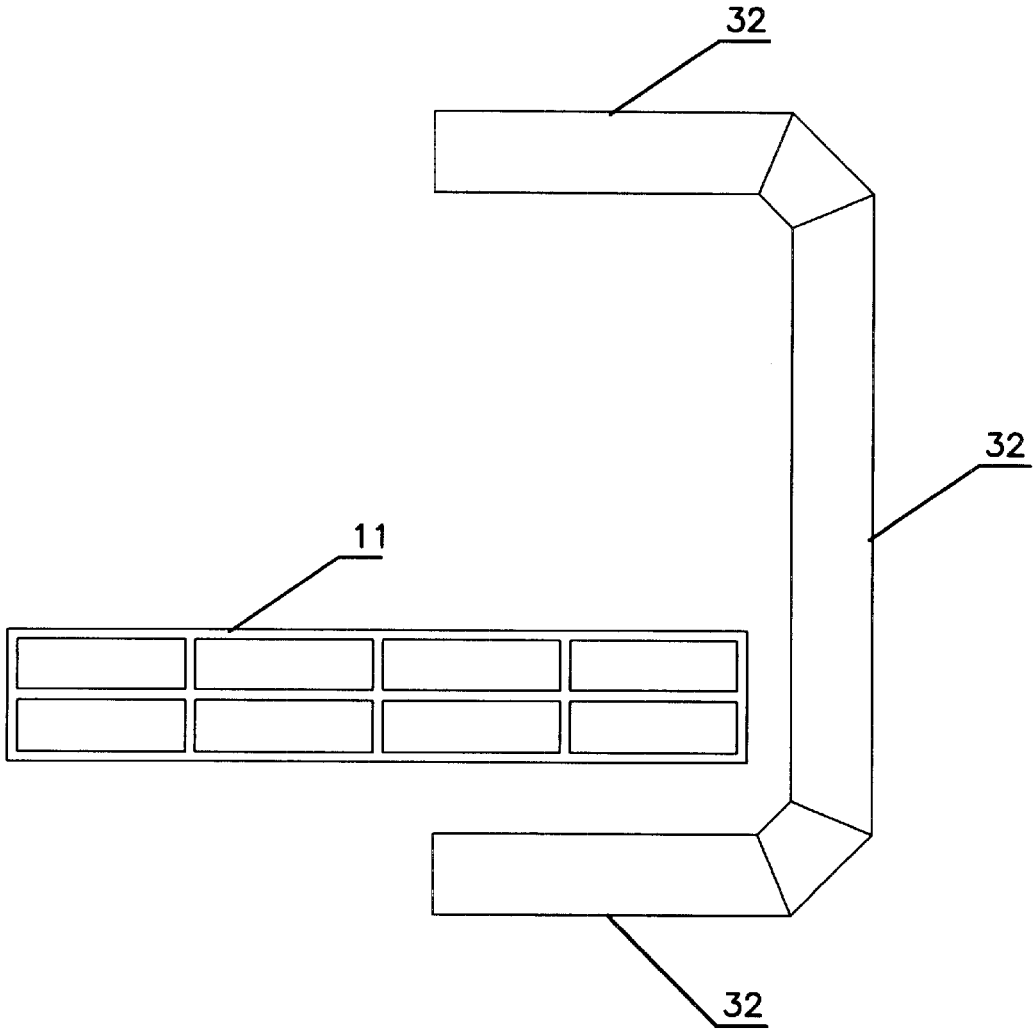
FIG. 18 shows a front view of the "Ultraviolet Light Curtain" layout according to the invention.
Figure 19:
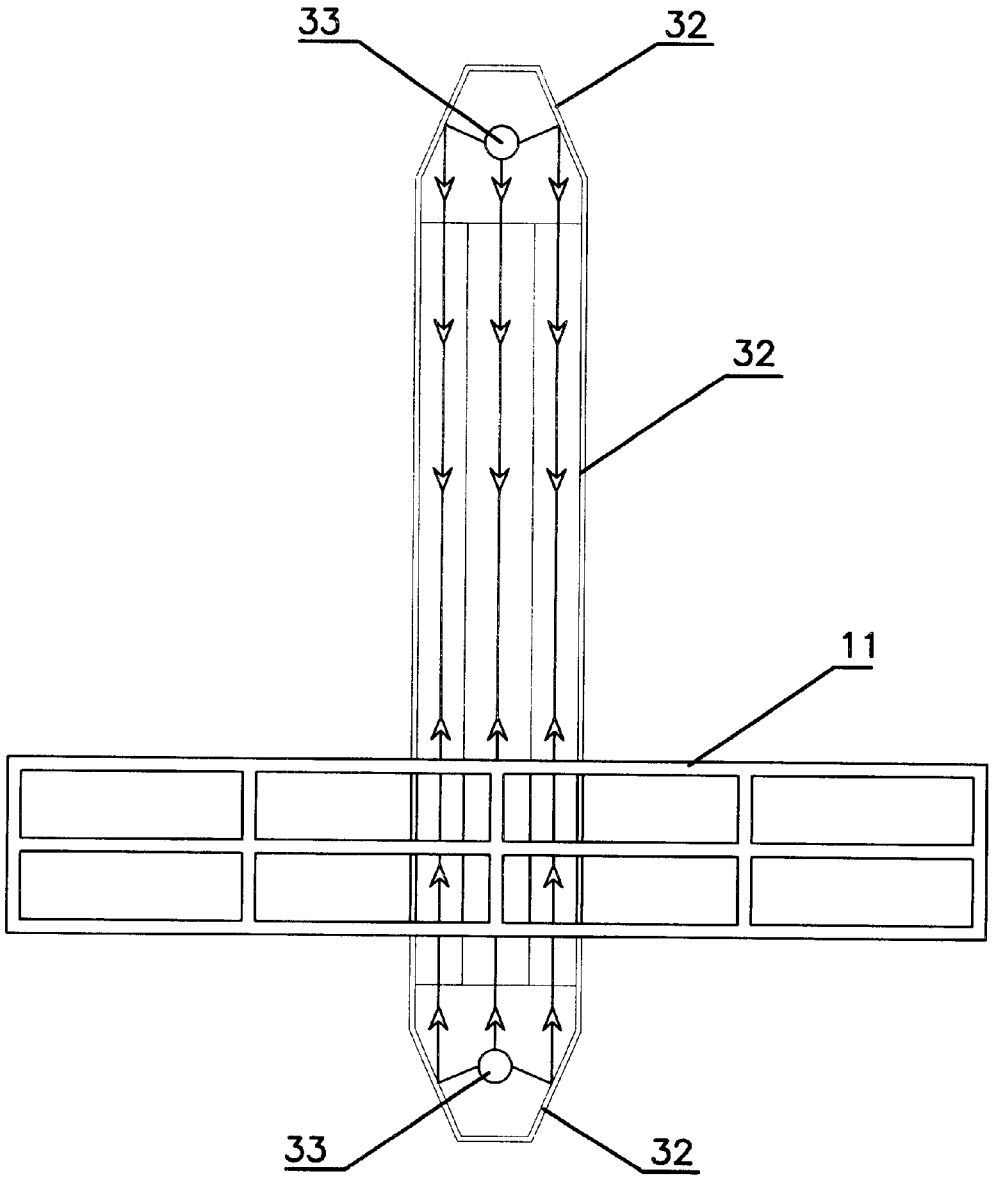
FIG. 19 shows a plan view of the "Ultraviolet Light Curtain" layout with the light source according to the invention.
Figure 20:
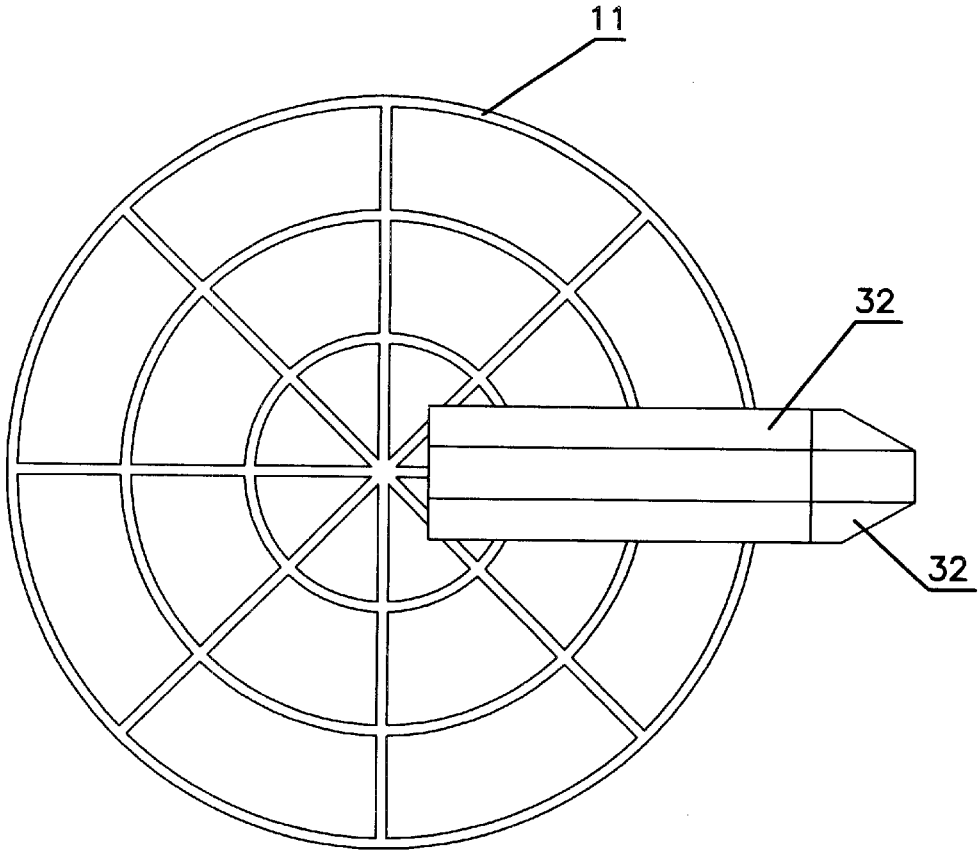
FIG. 20 shows a plan view of the "Ultraviolet Light Curtain" layout according to the invention.

Another novel feature of the invention is a unique "Rotating Rack Ultraviolet Light Curtain" sterilizing method. In this method, a loaded rotating dish-rack [11] is sterilized when it continuously passes through an "Ultraviolet Light Curtain" as shown in FIGS. 17 to 20. Basically, the methodology used in the "Ultraviolet Light Curtain" is by focusing and re-channeling "direct" and "reflected" ultraviolet light to a specific area to enhance the "direct ultraviolet light sterilizing effect. The specific ultraviolet light focusing area formed an imaginary "Light Curtain". The "Ultraviolet Light Curtain" design involves two ultraviolet light sources [33], which are generally located above and below the rotating dish-rack 11. A plurality of ultraviolet light reflect panels [32] are used to form the "Ultraviolet Light Curtain" and to channel the ultraviolet light from an ultraviolet light source [33] to designated locations for sterilizing purposes as shown in FIGS. 17 and 19. The novel sterilizing method greatly improved the overall ultraviolet light sterilizing effect by enhancing the ultraviolet light density and coverage. In addition, the "Rotating Rack Ultraviolet Light Curtain" concept also can be applied to a conveyor type dishwashing machine by modifying the rotating rack mechanism to conveyor type transferring mechanism.

Theoretically, ultraviolet light travels in a straight line from an ultraviolet light source and will only be reflected when it hit a "reflect" surface. The ultraviolet light will change the biological structure of microorganisms, which are exposed to the ultraviolet light over a period of time. The biological structure change will eventually deactivate or kill the microorganisms.

Figure 7:
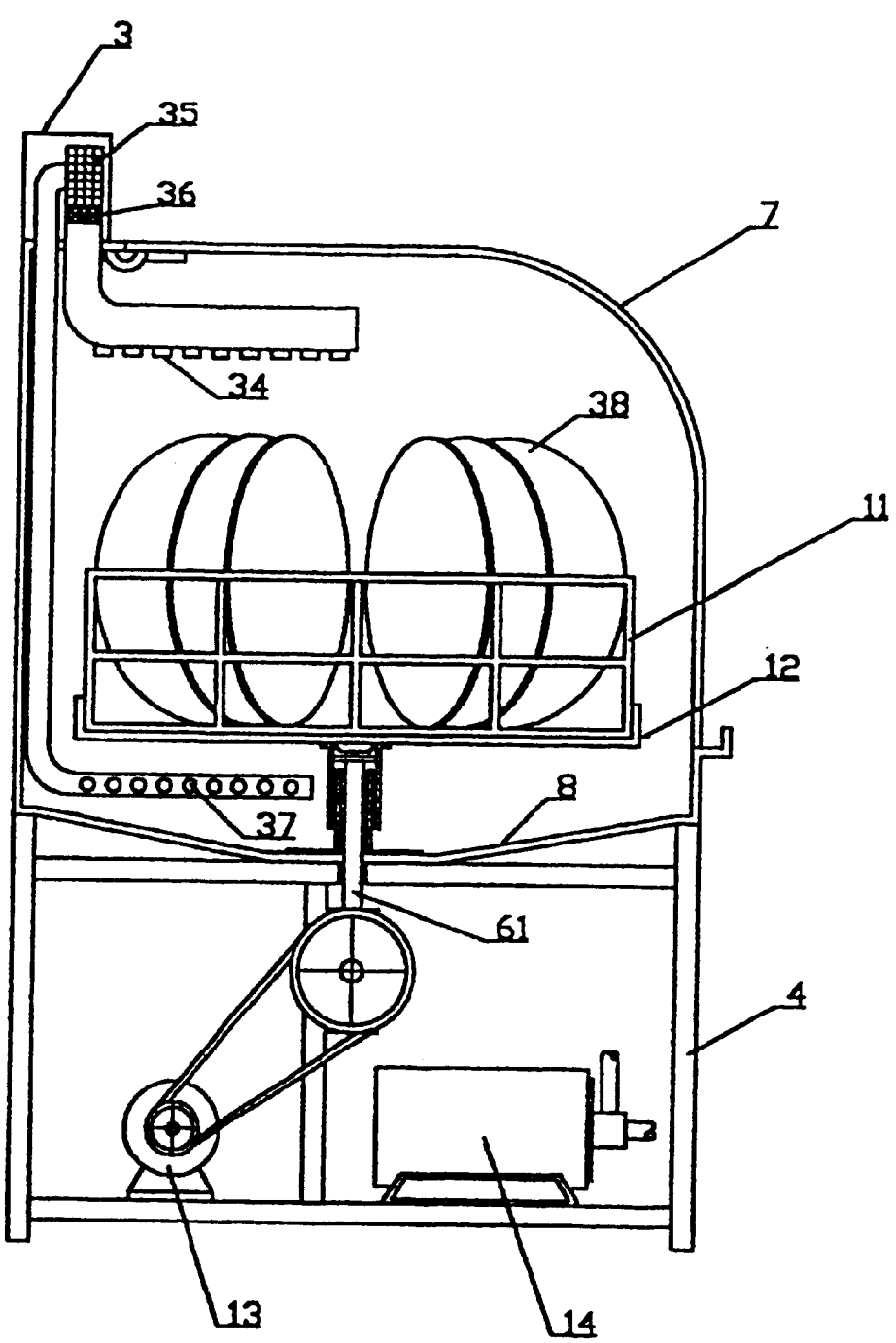
FIG. 7 shows a transverse vertical section through the main cabinet of the dishwashing machine according to the invention, where the "Re-circulating and Non Re-circulating Spray Arms" structure and the "Rotating Rack Ultraviolet Light Curtain" structure are not shown.
Figure 8:
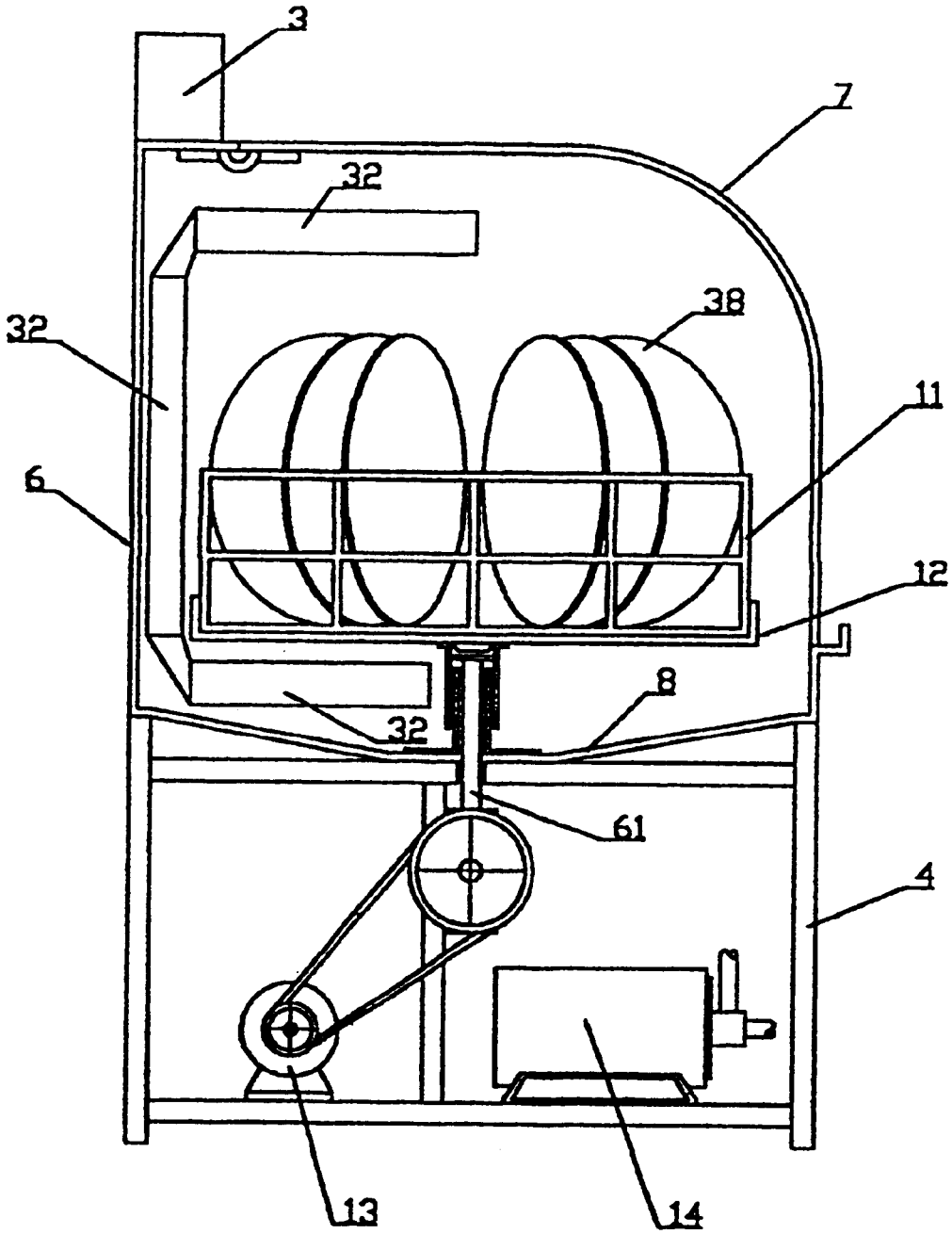
FIG. 8 shows a transverse vertical section through the main cabinet of the dishwashing machine according to the invention, where the "Re-circulating and Non Re-circulating Spray Arms" structure and the "Rotating Rack Air Curtain" structure are not shown.

Another novel feature of the invention is a "Rotating Rack Air Curtain" drying system. In this drying system, a loaded rotating dish-rack [11] is sterilized and dried when it continuously passes through an air curtain as shown in FIGS. 4 and 7.

Basically, the methodology used in the "Rotating Rack Air Curtain" drying system is by generating an even pattern of "hot air curtain" blowing at the rotating dish-rack [11] and re-heating the continuously return "used" hot air. Studies shown that the "Rotating Rack air Curtain" drying system generally outperforms the conventional hot air drying system which does not have the combination advantages of the evenly distributed hot air flow and the "used" hot air re-heating process.

Theoretically, a "hot air curtain" is a continuous flow of pressurized hot air through a row of opening. Referring to FIGS. 4 and 7, the pressurized hot air flow of the "hot air curtain" is forced or blown toward the rotating dish-rack [11] from a hot air blower opening [34] located above the rotating dish-rack [11]. The hot air blower [35] is equipped with high voltage heating element [36] which is normally activated for high temperature drying process. The heating element [35] of the hot air blower could be deactivated for cost saving drying purposes.

A return hot air piping [37] is included in the system to allow the "used" hot air to return to the hot air blower [35]. Generally, a large proportion of "used" hot air is returned to the hot air blower [35] through the return air piping [37]. Only a small fraction of "used" hot air is exhausted through the rotate-able drain pipe [23]. The returned "used" hot air will be further heated up at the hot air blower [35] when it is blowing into the dish-cleaning compartment [5] again. A critical criterion of the drying system is the continuous presenting or repeat presenting of loaded dish-rack within the hot air flowing path.

The overall dish-cleaning step begins with loading soiled dishes [38] onto a dish-rack [11], which is then transferred to the rotating dish-rack holder [12] at the dish-cleaning compartment [5]. After transferring the dish-rack [11] onto the rotating dish-rack holder [12], a machine operator will close the cover [7] at the dish-cleaning compartment [5].

The machine operator will then proceed to turn on the power supply and select a desired machine operating mode. The machine operating is controlled by a controlling means, which is equipped with multiple operating modes. The operating modes are classified into two main categories, which are dish-cleaning mode and dish-drying mode. The controlling means allows the dishwashing machine to perform a single dish-cleaning mode, a single dish-drying mode or a combination of both dish-cleaning and dish-drying mode. In order to improve the flexibility of the machine operating mode, the dish-cleaning mode and the dish-drying mode are further classified into sub-modes, such as fast dish-cleaning sub-mode, standard dish-cleaning sub-mode, extended dish-cleaning sub-mode, fast dish-drying sub mode, standard dish-drying sub-mode, extended dish-drying sub-mode and other sub-modes.

After turning on the power supply and selecting an operating mode, the dishwashing machine will start operating when the machine operator presses a "start" button at the control panel.

If only the dish-cleaning mode is selected, the dishwashing machine will only perform dish-cleaning operation, which includes a flush cycle, a wash cycle and a rinse cycle. The duration of the dish-cleaning operation is depended on the selected dish-cleaning sub-mode. In addition, a unique "Post Flush Cycle Delay" period is included in the dish-cleaning mode to improve the dish-cleaning efficiency. The "Post flush Cycle Delay" period allow "used" re-circulating fluid to be drained away from the dish-cleaning compartment before the subsequent wash cycle. Besides, the "Rotating Rack Ultraviolet Light Curtain" sterilizing can be activated during the dish-cleaning operation if the feature is included and selected.

During the flush cycle, when a cover sensor indicates that the cover [7] is properly closed, the electric motor [13] of the dish-rack rotating mechanism, the non re-circulating fluid pump [15] and the first solenoid [27] of the "Dual solenoid Drainage Mechanism" will be activated (assuming "Dual Solenoid Drainage Mechanism" is in-used). The electric motor [13] will drive the dish-rack rotating mechanism throughout the flush cycle while the first solenoid [27] of the drainage mechanism will pull the "Dual Solenoid parallel plate" [29] to position the lower opening of the rotate-able drain pipe [23] at the waste filter tank [20].

During the flush cycle, the loaded dish-rack [11] continues to rotate at the dish-cleaning compartment [5], while the non re-circulating fluid (flush fluid) sprays from the non re-circulating spray arm [10] onto the soiled dishes [38] to remove or flush away the food residue and other contamination from the soiled dishes and dish-cleaning compartment (assuming "Single Level Type-C" spray arms are in used). The flush cycle is a critical cycle, as a large proportion of food residue and other contamination will be flushed away from the soiled dish [38] and also from the dish-cleaning compartment [5] to avoid cross contamination in re-circulating fluid (wash fluid) during the subsequent wash cycle.

The casing base [8] of the dish-cleaning compartment [5] is used to receive "used" flush fluid during the flush cycle. The "used" flush fluid will be channeled immediately into the waste filter tank [20] through the rotate-able drain pipe [23] of the drainage mechanism, which is attached to pipe [23] of the drainage mechanism, which is attached to the casing base [8]. The "used" flush fluid will be filtered at the waste gathering basket [22 ] in the waste filter tank [20]. Eventually, the "used" flush fluid will be discharged from the waste filter tank [20]. In the flush cycle, the non re-circulation fluid pump is used to draw the non re-circulating fluid (fresh flush fluid) from the non re-circulating fluid tank [19] at a boosted pressure to the non re-circulating fluid spray arm [10] located at the dish-cleaning compartment [5]. The non re-circulating fluid pump [15] will stop operating at the end of the flush cycle. After the flush cycle has been completed, the dishwashing machine operation will be on hold for a short "Post flush Cycle Delay" period before proceeding to the subsequent wash cycle. The purpose of introducing this "Post flush Cycle Delay" period is to allow the "used" flush fluid to be drained away effectively from the casing base before the beginning of the wash cycle to minimize cross contamination.

During the wash cycle, the electric motor [13] of the rotating dish-rack mechanism will continuously be activated but the first solenoid [27] of the "Dual Solenoid Drainage Mechanism" will be de-activated. The second solenoid [28] of the "Dual Solenoid Drainage Mechanism" will be activated and pull the "Dual Solenoid Parallel Plate" to position the lower opening of the rotate-able drain pipe [23] to the re-circulating fluid tank [18]. On the other hand, the re-circulating fluid pump [14] will be activated to draw re-circulating fluid (wash fluid) from the re-circulating fluid tank [18] at a boosted pressure to the re-circulating fluid spray arm [9] located at the dish-cleaning compartment [5]. Besides, an automatic chemical dispenser can be activated to dispense cleaning chemical into the re-circulating fluid tank [18] at the beginning of the the wash cycle.

During the wash cycle, the loaded dish-rack [11] will continue to rotate and the wash fluid is continuously sprayed from the re-circulating spray arm [9] onto the soiled dishes [38] to remove the left over "used" flush fluid, food residue and other oily contamination, which the flush cycle is not capable of removing completely. The casing base [8], which is located at the dish-cleaning compartment [5] will be used to collect and immediately channel the "used" wash fluid into re-circulating fluid tank [18]. The "used" wash fluid is filtered at the slanted filtering net [21] in the re-circulating fluid tank [18]. The filtered "used" wash fluid will continuously be re-circulating or re-cycle during the wash cycle. On the other hand, the filtered waste from the "used" wash fluid will slide down from the slanted filtering net [21] and is collected at the waste gathering basket [22] in the waste filter tank [20]. Typically, the wash fluid is highly concentrated with washing agent such as dish-wash soap. Chemically treated fluid can also be used.

In addition, heated wash fluid can be introduced for heavy wash cycle. After completing the wash cycle, the dishwashing machine will proceed to the rinse cycle.

During the rinse cycle, the non re-circulating fluid pump [15] will be activated again to draw non re-circulating fluid (rinse fluid) from the non re-circulating fluid tank [19] at a boosted pressure to the non re-circulating fluid spray arm [10] located at the dish-cleaning compartment [5]. Besides, an automatic chemical dispenser can be activated to dispense rinse chemical into the non re-circulating fluid tank [19] at the beginning of the rinse cycle. However, in most cases the rinse fluid used in rinse cycle is not chemically treated. Chemically treated and heated rinse fluid could be introduced for heavy rinse cycle.

During the rinse cycle, when the loaded dish-rack [11] is rotating at the dish-cleaning compartment [5], the rinse fluid is continuously sprayed from the non re-circulating spray arm [10] onto the soiled dishes [38] to remove the left over "used" wash fluid and other contamination. The rinse cycle has a primary rinse cycle and a secondary rinse cycle.

During the primary rinse cycle, the electric motor [13] of the rotating dish-rack mechanism and the second solenoid [28] of the Dual Solenoid Drainage Mechanism" will continuously be activated. The activated second solenoid [28] pulled the "Dual Solenoid Parallel Plate" [29] to position the lower opening of the rotate-able drain pipe [23] at the re-circulating fluid tank [18]. The casing base [8] of the dish-cleaning compartment [5] will be used to collect and immediately channel the "used" rinse fluid into the re-circulating fluid tank [18]. The "used" rinse fluid is filtered at the slanted filtering net [21] in the re-circulating tank [18]. The filtered "used" rinse fluid will then mixed with the wash fluid which in turn regenerates the wash fluid. The filtered waste from the "used" rinse fluid will slide down from the slanted filtering net [21] and is collected in the waste gathering basket [22] at the waste filter tank [20]. The step of regenerating the wash fluid by using "used" rinse fluid greatly improves the overall water usage per dish.

During the secondary rinse cycle, the electric motor [13] of the rotating dish-rack mechanism will continuously be activated but the second solenoid [28] of the "Dual Solenoid Drainage Mechanism" will be deactivated. On the other hand, the first solenoid [27] of "Dual Solenoid Drainage Mechanism" will be turn on. The activated first solenoid [27] will pull the "Dual Solenoid Parallel Plate" [29] to position the lower opening of the rotate-able drain pipe [23] at the waste filter tank [20]. The "used" rinse fluid is collected at the casing base [8] and is immediately channeled into the waste filter tank [20]. The "used" rinse fluid is filtered in the water gathering basket [22] at the waste filter tank [20]. Eventually, the filtered "used" rinse fluid will be discharge from the waste filter tank [20]. The non re-circulating fluid pump [18] and the first solenoid [27] will be de-activated at the end of the secondary rinse cycle.

After completing the secondary rinse cycle, the dishwashing machine will proceed to the dish-drying operation if the dish-drying mode is selected. However, if the dish-drying mode is not selected, at the end of the secondary rinse cycle, the electric motor [13] of the dish-rack rotating mechanism will be deactivated and subsequently an operation completion buzzer will be activated for a few seconds to indicate that the dish-cleaning operation is completed.

The dishwashing machine will perform only the dish-drying operation if only the dish-drying mode is selected. In addition, the "Rotating Rack Ultraviolet Light Curtain" sterilizer can be activated during the dish-drying operation if the feature is included and selected. The duration of the dish-drying operation depends on the selected dish-drying operation's sub-mode.

During the dish-drying operation, the electric motor [13] of the dish-rack rotating mechanism and the hot air blower [35] of the "Rotating Rack Air Curtain" drying system will be activated. The electric motor [13] will drive the dish-rack rotating mechanism, which rotates the loaded dish-rack at the dish-cleaning compartment [5] through out the dish-drying operation.

During the dish-drying operation, the loaded rotating dish-rack [11] is sterilized and dried when it continuously passes through the "hot air curtain" as shown in FIGS. 4 and 7. At the end of the dish-drying operation, the electric motor [13] of the dish-rack rotating mechanism and the hot air blower [35] of the "Rotating Rack Air Curtain" drying system will be de-activated. At the same time, the operation completion buzzer will be activated for a few seconds to indicate the dish-drying operation is completed.

If both dish-cleaning mode and dish-drying mode are selected, the dishwashing machine will first perform the dish-cleaning operation and then follows by the dish-drying operation. The operation completion buzzer will only be activated at the end of the dish-drying operation. The "Rotating Rack Ultraviolet Light Curtain" sterilizer can be activated during the dish-cleaning and dish-drying operations if the feature is included and selected.

While the preferred embodiments of the present invention and their advantages have been disclosed in the detailed description, the invention is not limited thereto, but only by the spirit and scope of the appended claims.

What is claimed is:

1. A single chamber dishwashing machine comprising:

a dish-cleaning compartment having a cover and a casing;

a re-circulating fluid spraying system wherein a re-circulating fluid is delivered to a re-circulating fluid spray arm;

a non re-circulating fluid spraying system wherein a non re-circulating fluid is delivered to a non re-circulating fluid spray arm;

a dish-rack rotating mechanism and drive for rotating a dish-rack holder and a dish-rack;

a drainage mechanism for chanelling a used flush fluid, a used wash fluid or a used rinse fluid from the dish-cleaning compartment to a designated drain location; and a controlling means for controlling a dishwashing machine operation.

2. A single chamber dishwashing machine according to claim 1 further comprising:

a re-circulating fluid tank for holding the re-circulating fluid including a fresh wash fluid, the used wash fluid and the used rinse fluid;

a non re-circulating fluid tank for holding the non re-circulating fluid including a fresh flush fluid and a fresh rinse fluid;

a waste filter tank for filtering the used flush fluid, the used wash fluid and the used rinse fluid;

a re-circulating fluid pumping system for pumping the re-circulating fluid from the re-circulating fluid tank to the re-circulating fluid spray arm; and a non re-circulating fluid pumping system for pumping the non re-circulating fluid from the non re-circulating fluid tank to the non re-circulating fluid spray arm.

3. A single chamber dishwashing machine according to claim 2 wherein the re-circulating fluid pumping system and the non re-circulating pumping system are isolated for minimising cross contamination.

4. A single chamber dishwashing machine according to claim 2 wherein the re-circulating fluid tank and the non re-circulating fluid tank having an automated chemical dispenser.

5. A single chamber dishwashing machine according to claim 2 wherein the re-circulating fluid tank and the non re-circulating fluid tank having a fluid heating system.

6. A single chamber dishwashing machine according to claim 1 wherein the re-circulating fluid spray arm and the non re-circulating fluid spray arm are positioned to extend from a location above the dish-rack to a location below the rotating dish-rack holder and about an outer diameter side of the rotating dish-rack holder.

7. A single chamber dishwashing machine according to claim 1 wherein the re-circulating fluid spray arm and the non re-circulating fluid spray arm are positioned to extend from a location below the rotating dish-rack holder about an outer diameter side of the rotating dish-rack holder to a location above the dish-rack and extending down to a center of the rotating dish-rack holder.

8. A single chamber dishwashing machine according to claim 1 wherein a plurality of rotating dish-rack holders are commonly connected with an extended rotate-able connecting shaft that is connected to the dish-rack rotating mechanism for forming a multilevel dish-rack loading system.

9. A single chamber dishwashing machine according to claim 1 wherein the re-circulating fluid spray arm and the non re-circulating fluid spray arm having a plurality of nozzles for forming multiple angles spraying pattern.

10. A single chamber dishwashing machine according to claim 1 wherein the re-circulating fluid spray arm and the non re-circulating fluid spray arm are pivotable for swinging a water jet.

11. A single chamber dishwashing machine according to claim 1 wherein the drainage mechanism has either an electrically activated solenoid and a resilient means or has a plurality of electrically activated solenoids for shifting and displacing a lower end opening of a rotate-able drain pipe.

12. A single chamber dishwashing machine according to claim 1 further comprising a sterilising or drying system where a loaded rotating dish-rack is sterilised or dried when it continuously passes through a hot air curtain or an ultraviolet light.

13. A method for cleaning a dish comprising the steps of:

(i) providing a single chamber dishwashing machine having a dish-cleaning compartment having a cover and a casing; a re-circulating fluid spraying system wherein a re-circulating fluid is delivered to a re-circulating fluid spray arm; a non re-circulating fluid spraying system wherein a non re-circulating fluid is delivered to a non re-circulating fluid spray arm; a dish-rack rotating mechanism and drive for rotating a dish-rack holder and a dish-rack; a drainage mechanism for chanelling a used flush fluid, a used wash fluid or a used rinse fluid from the dish-cleaning compartment to a designated drain location; and a controlling means for controlling a dishwashing machine operation;

(ii) transferring a loaded dish-rack to the rotating dish-rack holder at the dish-cleaning compartment;

(iii) rotating the loaded dish-rack together with the dish-rack holder by the dish-rack rotating mechanism and drive;

(iv) flushing the loaded dish-rack in the dish-cleaning compartment using the non re-circulating fluid spray arm;

(v) washing the loaded dish-rack in the dish-cleaning compartment using the re-circulating fluid spray arm; and (vi) rinsing the loaded dish-rack in the dish-cleaning compartment using the non re-circulating fluid spray arm.

14. A method for cleaning a dish according to claim 13 further comprising the step of holding a dish-cleaning operation immediately after flushing for a pre-defined time period for allowing a used flush fluid to be drained away from the dish-cleaning compartment before beginning a subsequent washing.

15. A method for cleaning a dish according to claim 13 further comprising the step of drying or sterilising the dish by continuing to rotate and passing the dish through a hot air curtain or an ultraviolet light.

16. A method for cleaning a dish according to claim 13 further comprising the step of dispensing a pre-determined amount of washing agent or other chemical into a re-circulating fluid tank or a non re-circulating fluid tank.

17. A method for cleaning a dish according to claim 13 further comprising the step of heating a re-circulating fluid or a non re-circulating fluid at a re-circulating fluid tank or a non re-circulating fluid tank respectively.

18. A method for cleaning a dish according to claim 13 further comprising the steps of primary rinsing and secondary rinsing wherein during the primary rinsing step, a used rinse fluid is chanelled to a re-circulating fluid tank for regenerating a wash fluid while during the secondary rinsing step, the used rinse fluid is chanelled to a waste filter tank and is eventually discharged from the dishwashing machine.

* * * * *